US008493293B2

(12) United States Patent
Routley et al.

(10) Patent No.: US 8,493,293 B2
(45) Date of Patent: Jul. 23, 2013

(54) CURRENT DRIVE DISPLAY SYSTEM

(75) Inventors: Paul Richard Routley, Longstanton (GB); Olivier Le-Briz, Saint-Gervais (FR)

(73) Assignees: Cambridge Display Technology Limited (GB); STMicroelectronics S.A. (FR)

( * ) Notice: Subject to any disclaimer, the term of this patent is extended or adjusted under 35 U.S.C. 154(b) by 586 days.

(21) Appl. No.: 12/224,815

(22) PCT Filed: Mar. 6, 2007

(86) PCT No.: PCT/GB2007/050102

§ 371 (c)(1),
(2), (4) Date: Aug. 3, 2010

(87) PCT Pub. No.: WO2007/102024

PCT Pub. Date: Sep. 13, 2007

(65) Prior Publication Data

US 2010/0289779 A1 Nov. 18, 2010

(30) Foreign Application Priority Data

Mar. 9, 2006 (GB) ..... 0604740.1

(51) Int. Cl.
*G09G 3/30* (2006.01)

(52) U.S. Cl.
USPC ..... 345/76; 345/82; 345/204

(58) Field of Classification Search
USPC ..... 345/76, 77, 82, 100, 204
See application file for complete search history.

(56) References Cited

U.S. PATENT DOCUMENTS

| | | | | |
|---|---|---|---|---|
| 5,128,674 | A * | 7/1992 | Kong et al. | 341/127 |
| 6,617,801 | B2 | 9/2003 | Ishizuka et al. | |
| 7,557,802 | B2 | 7/2009 | Hayafuji et al. | |
| 7,928,936 | B2 * | 4/2011 | Levey et al. | 345/77 |
| 8,115,704 | B2 | 2/2012 | Smith et al. | |
| 8,120,551 | B2 | 2/2012 | Yumoto | |

(Continued)

FOREIGN PATENT DOCUMENTS

| | | |
|---|---|---|
| EP | 1333422 A | 8/2003 |
| JP | 2002-351399 A | 12/2002 |

(Continued)

OTHER PUBLICATIONS

"International Application Serial No. PCT/GB2007/050102, International Preliminary Report on Patentability mailed Sep. 9, 2008", 7 pgs.

(Continued)

*Primary Examiner* — Koosha Sharifi-Tafreshi
(74) *Attorney, Agent, or Firm* — Schwegman Lundberg & Woessner, P.A.

(57) ABSTRACT

This invention relates to systems, methods and apparatus for driving organic light emitting diodes (OLED) displays, in particular those using multi-line addressing (MLA) techniques. Embodiments of the invention are particularly suitable for use with so-called passive matrix OLED displays. A current drive system for an electroluminescent display, the system comprising: a plurality of current mirrors having a plurality of outputs for driving a plurality of drive electrodes of said display, each said current mirror having a reference signal input; and an automatic selector coupled to said current mirror outputs to automatically select a said output for providing reference signal inputs to said current mirrors.

18 Claims, 21 Drawing Sheets

U.S. PATENT DOCUMENTS

| | | | | |
|---|---|---|---|---|
| 8,125,479 | B2 | 2/2012 | Hayafuji et al. | |
| 2003/0234754 | A1 | 12/2003 | Abe et al. | |
| 2005/0017931 | A1* | 1/2005 | Toyoshima et al. | 345/76 |
| 2005/0024300 | A1* | 2/2005 | Abe et al. | 345/76 |
| 2005/0104822 | A1 | 5/2005 | Seki | |
| 2005/0140610 | A1* | 6/2005 | Smith et al. | 345/77 |
| 2005/0237284 | A1* | 10/2005 | Yaguma et al. | 345/76 |

FOREIGN PATENT DOCUMENTS

| | | | |
|---|---|---|---|
| JP | 2003-195815 | A | 7/2003 |
| JP | 2004-078163 | A | 3/2004 |
| JP | 2005-107003 | A | 4/2005 |
| JP | 2005-148248 | A | 6/2005 |
| JP | 2005-524107 | A | 8/2005 |
| JP | 2008-515016 | A | 5/2008 |
| WO | WO-03/091983 | A1 | 11/2003 |
| WO | WO-2006035246 | | 4/2006 |

OTHER PUBLICATIONS

"International Applicaton Serial No. PCT/GB2007/050102; International Search Report mailed May 29, 2007", 2 pgs.

"International Application Serial No. PCT/GB2007/050102, Written Opinion mailed May 29, 2007", 6 pgs.

* cited by examiner

300

CURRENT DRIVE DISPLAY SYSTEM

RELATED APPLICATIONS

This application is a nationalization under 35 U.S.C. 371 of PCT/GB2007/050102, filed 6 Mar. 2007 and published as WO 2007/102024, on 13 Sep. 2007, which claimed priority under 35 U.S.C. 119 to United Kingdom Application No. 0604740.1, filed 9 Mar. 2006, which applications and publications are incorporated herein by reference and made a part hereof.

TECHNICAL FIELD

This invention relates to systems, methods and apparatus for driving organic light emitting diodes (OLED) displays, in particular using multi-line addressing (MLA) techniques. Embodiments of the invention are particularly suitable for use with so-called passive matrix OLED displays.

BACKGROUND

Multi-line addressing techniques for liquid crystal displays (LCDs) have been described, for example in US2004/150608, US2002/158832 and US2002/083655, for reducing power consumption and increasing the relatively slow response rate of LCDs. However these techniques are not suitable for OLED displays because of differences stemming from the fundamental difference between OLEDs and LCDs that the former is an emissive technology whereas the latter is a form of modulator. Furthermore, an OLED provides a substantially linear response with applied current and whereas an LCD cell has a non-linear response which varies according to the RMS (root-mean-square) value of the applied voltage.

BRIEF SUMMARY OF THE INVENTION

Displays fabricated using OLEDs provide a number of advantages over LCD and other flat panel technologies. They are bright, colourful, fast-switching (compared to LCDs), provide a wide viewing angle and are easy and cheap to fabricate on a variety of substrates. Organic (which here includes organometallic) LEDs may be fabricated using materials including polymers, small molecules and dendrimers, in a range of colours which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-colour pixellated display. A multicoloured display may be constructed using groups of red, green, and blue emitting pixels. So-called active matrix displays have a memory element, typically a storage capacitor and a transistor, associated with each pixel whilst passive matrix displays have no such memory element and instead are repetitively scanned to give the impression of a steady image. Other passive displays include segmented displays in which a plurality of segments share a common electrode and a segment may be lit up by applying a voltage to its other electrode. A simple segmented display need not be scanned but in a display comprising a plurality of segmented regions the electrodes may be multiplexed (to reduce their number) and then scanned.

FIG. 1*a* shows a vertical cross section through an example of an OLED device 100. In an active matrix display part of the area of a pixel is occupied by associated drive circuitry (not shown in FIG. 1*a*). The structure of the device is somewhat simplified for the purposes of illustration.

The OLED 100 comprises a substrata 102, typically 0.7 mm or 1.1 mm glass but optionally clear plastic or some other substantially transparent material. An anode layer 104 is deposited on the substrate, typically comprising around 150 nm thickness of ITO (indium tin oxide), over part of which is provided a metal contact layer. Typically the contact layer comprises around 500 nm of aluminium, or a layer of aluminium sandwiched between layers of chrome, and this is sometimes referred to as anode metal. Glass substrates coated with ITO and contact metal are available from Corning, USA. The contact metal over the ITO helps provide reduced resistance pathways where the anode connections do not need to be transparent, in particular for external contacts to the device. The contact metal is removed from the ITO where it is not wanted, in particular where it would otherwise obscure the display, by a standard process of photolithography followed by etching.

A substantially transparent hole transport layer 106 is deposited over the anode layer, followed by an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise a conductive transparent polymer, for example PEDOT:PSS (polystyrene-sulphonate-doped polyethylene-dioxythiophene) from Bayer AG of Germany. In a typical polymer-based device the hole transport layer 106 may comprise around 200 nm of PEDOT; a light emitting polymer layer 108 is typically around 70 nm in thickness. These organic layers may be deposited by spin coating (afterwards removing material from unwanted areas by plasma etching or laser ablation) or by inkjet printing. In this latter case banks 112 may be formed on the substrate, for example using photoresist, to define wells into which the organic layers may be deposited. Such wells define light emitting areas or pixels of the display.

Cathode layer 110 typically comprises a low work function metal such as calcium or barium (for example deposited by physical vapour deposition) covered with a thicker, capping layer of aluminium. Optionally an additional layer may be provided immediately adjacent the electroluminescent layer, such as a layer of lithium fluoride, for improved electron energy level matching. Mutual electrical isolation of cathode lines may achieved or enhanced through the use of cathode separators (not shown in FIG. 1*a*).

The same basic structure may also be employed for small molecule and dendrimer devices. Typically a number of displays are fabricated on a single substrate and at the end of the fabrication process the substrate is scribed, and the displays separated before an encapsulating can is attached to each to inhibit oxidation and moisture ingress.

To illuminate the OLED power is applied between the anode and cathode, represented in FIG. 1*a* by battery 118. In the example shown in FIG. 1*a* light is emitted through transparent anode 104 and substrate 102 and the cathode is generally reflective; such devices are referred to as "bottom emitters". Devices which emit through the cathode ("top emitters") may also be constructed, for example by keeping the thickness of cathode layer 110 less than around 50-100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

Referring now to FIG. 1*b*, this shows a simplified cross-section through a passive matrix OLED display device 150, in which like elements to those of FIG. 1*a* are indicated by like reference numerals. As shown the hole transport 106 and electroluminescent 108 layers are subdivided into a plurality of pixels 152 at the intersection of mutually perpendicular anode and cathode lines defined in the anode metal 104 and cathode layer 110 respectively. In the figure conductive lines 154 defined in the cathode layer 110 run into the page and a cross-section through one of a plurality of anode lines 158 running at right angles to the cathode lines is shown. An electroluminescent pixel 152 at the intersection of a cathode and anode line may be addressed by applying a voltage between the relevant lines. The anode metal layer 104 provides external contacts to the display 150 and may be used for both anode and cathode connections to the OLEDs (by running the cathode layer pattern over anode metal lead-outs). The above mentioned OLED materials, in particular the light emitting polymer and the cathode, are susceptible to oxidation and to moisture and the device is therefore encapsulated in a metal can 111, attached by UV-curable epoxy glue 113 onto anode metal layer 104, small glass beads within the glue preventing the metal can touching and shorting out the contacts.

Referring now to FIG. 2, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Preferably, however, to allow individual pixels to remain on for longer and hence reduce overall drive level, a row is selected and all the columns written in parallel, that is a current driven onto each of the column lines simultaneously to illuminate each pixel in a row at its desired brightness. Each pixel in a column could be addressed in turn before the next column is addressed but this is not preferred because, inter alia, of the effect of column capacitance.

The skilled person will appreciate that in a passive matrix OLED display it is arbitrary which electrodes are labelled row electrodes and which column electrodes, and in this specification "row" and "column are used interchangeably.

It is usual to provide a current-controlled rather than a voltage-controlled drive to an OLED because the brightness of an OLED is determined by the current flowing through the device, this determining the number of photons it generates. In a voltage-controlled configuration the brightness can vary across the area of a display and with time, temperature, and age, making it difficult to predict how bright a pixel will appear when driven by a given voltage. In a colour display the accuracy of colour representations may also be affected.

The conventional method of varying pixel brightness is to vary pixel on-time using Pulse Width Modulation (PWM). In a conventional PWM scheme a pixel is either full on or completely off but the apparent brightness of a. pixel varies because of integration within the observer's eye. An alternative method is to vary the column drive current.

FIG. 3 shows a schematic diagram 300 of a genetic driver circuit for a passive matrix OLED display according to the prior art. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Some examples of OLED display drivers are described in U.S. Pat. Nos. 6,014,119, 6,201,520, 6,332,661, EP 1,079,361A and EP 1,091,339A and OLED display driver integrated circuits employing PWM are sold by Clare Micronix of Clare, Inc., Beverly, Mass., USA. Some examples of improved OLED display drivers are described in the Applicant's co-pending applications WO 03/079322 and WO 03/091983. In particular WO 03/079322, hereby incorporated by reference, describes a digitally controllable programmable current generator with improved compliance.

There is a continuing need for techniques which can improve the lifetime of an OLED display. There is a particular need for techniques which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. The inventors have recognised that multi-line addressing techniques can be employed to reduce peak display drive levels, in particular in passive matrix OLED displays, and hence increase display lifetime.

Current Mirror Driver Systems

One of the applicants (Cambridge Display Technology Limited) has previously described, for example in UK Patent Applications No. 0421710.5, 0421711.3, 0421711.3 all filed on 30 Sep. 2004, multi-line addressing methods for OLED displays, in particular passive matrix OLED displays. Broadly speaking in embodiments these methods comprise driving a plurality of column electrodes of the OLED display with a first set of column drive signals at the same time as driving two or more row, electrodes of the display with a first set of row drive signals; then the column electrodes arc driven with a second set of column drive signals at the same time as the two or more row electrodes are driven with a second set of row drive signals. Preferably the row and column drive signals comprise current drive signals from a substantially constant current generator such as a current source or current sink. Preferably such a current generator is controllable or programmable, for example using a digital-to-analogue converter.

The effect of driving a column at the same time as two or more rows is to divide the column drive between the two or more rows in a proportion determined by the row drive signals—in other words for a current drive the current in a column is divided between the two or more rows in proportions determined by the relative values or proportions of the row drive signals. Broadly speaking this allows the luminescence profile of a row or line of pixels to be built up over multiple line scan periods rather than in only a single line scan period, thus effectively reducing the peak brightness of an OLED pixel thus increasing the lifetime of pixels of the display. With a current drive a desired luminescence of a pixel is obtained by moans of a substantially linear sum of successive sets of drive signals to the pixel.

A controllable current divider to divide column current drive signals between two or more rows in accordance with the row drive signals would be useful for implementing embodiments of an MLA method. (The skilled person will appreciate that in this context, references to rows and columns are interchangeable).

According to a first aspect of the invention there is therefore provided a current drive system for an electroluminescent display, the system comprising: a plurality of current mirrors having a plurality of outputs for driving a plurality of drive electrodes of said display, each said current mirror having a reference signal input; and an automatic selector coupled to said current mirror outputs to automatically select a said output for providing reference signal inputs to said current mirrors.

In some preferred embodiments the reference signal inputs of the current mirrors are coupled together to provide a common reference signal input (although in other arrangements a common current minor input stage may be employed with a plurality of separate mirror output stages. The current mirrors may be either current sources or current sinks; in some embodiments the reference signal input is a voltage input which is converted to a reference current by an input resistance. Preferably a current mirror comprises a multiplying digital-to-analogue converter—in this way the multiplication (or division) ratio of a current mirror may be digitally controlled to provide an output current (positive or negative) which is a selected multiple (less than or greater than unity) of a reference current determined by the reference signal input.

Minimum/Maximum Voltage Selection

In one set of preferred embodiments the selector is responsive to voltages on the current mirror outputs and in this way is responsive to voltages on the drive electrodes of the display. In some preferred embodiments the selector selects for use in deriving the reference signal a current mirror output having a voltage closest to a voltage of a power supply line of the current drive system, more particularly a (positive or negative) supply voltage or ground connection for the current mirrors. It will be appreciated that, at times, there may be more than one such connection (where more than one such connection is at substantially the same voltage which is also a maximum or minimum voltage) in which case the selector may select more than one signal for use in deriving a reference—although it will be appreciated the operation of a circuit need not be substantially affected by this since the multiply selected outputs are at substantially the same voltage.

Preferably the selector includes a control circuit to adjust the reference signal inputs (or common reference signal) responsive to the selected current mirror output, in particular to maintain a mirror ratio set by the current mirror circuit the output of which has been selected. For example, if the selected output moves away from the supply line to which it is closest the reference signal may be adjusted to bring the output back towards the supply line. In the case of a selector which selects a current mirror output with a substantially minimum voltage if, say, the magnitude of the voltage of the selected current mirror output increases (irrespective of sign) the (common) reference signal may be reduced to correct this (and vice versa).

In one preferred embodiment the selector comprises a plurality of transistors such as MOS transistors each having a control connection coupled to a current mirror output, an input connection coupled to a supply, and output connections connected in common for providing a signal from which a reference signal input for the current mirrors is to be derived. Where the output nearest ground is to be selected the current mirrors comprise current sinks and the transistors are p-type (MOS) transistors; for selecting based upon a maximum voltage the transistors are n-type (MOS) transistors and the current mirrors comprise current sources.

In one embodiment the input connections comprise drain connections connected together, for example to a negative supply ($V_{EE}$) and the output connections comprise source connections so that the transistors are in a source follower configuration. In this configuration the control circuit may comprise a non-inverting amplifier. In an alternative embodiment the input connections comprise source connections connected, for example, to a positive supply ($V_{CC}$) and the output connections comprise drain connections connected together to the control circuit. In this embodiment the control circuit may comprise an inverting amplifier. In a still further embodiment the input connections comprise connections to respective operational amplifiers rather than transistors, the outputs of which are coupled together to provide a signal from which a reference signal input for the current mirrors is to be derived.

In another aspect the invention provides a selector circuit comprising a plurality of transistors each having a control connection for coupling to a current mirror output, input connections connected together for connection to a supply, and output connections connected together for providing an output voltage corresponding to a voltage on a selected said input having a maximum or minimum voltage amongst the inputs.

According to another aspect of the invention there is provided a selector circuit comprising a plurality of operational amplifiers each having a first input, for coupling to a current mirror output, a second input and an output, and wherein said second inputs are connected in common for connection to a reference, and wherein said outputs are connected in common to provide an output for providing a reference for a said current mirror.

According to another aspect of the invention there is provided a current generator for an OLED display driver, the current generator comprising: a reference input to receive a reference signal; a ratioed current input to receive a ratioed current; a ratio control input to receive a ratio control signal input; a controllable current mirror having a control input coupled to said ratio control input, a current input coupled to said reference input, and an output coupled to said ratioed current input; said current generator being configured such that a signal on said control input controls a ratio of said ratioed current to said reference signal; and wherein said current generator further comprises a plurality of drive connection, and an automatic selector to select one of said drive connections to provide said reference signal.

The inputs received by the reference input and the ratio current input may be either positive or negative, that is the current generator may comprise either a pair of (controllable) current sinks or current sources.

In one preferred embodiment the selector is arranged in a feedback loop and configured to automatically select a drive connection with a voltage closest to a supply voltage for the current generator, for example closest to the current mirror positive (or negative) supply.

Preferably one current mirror is provided for each drive connection, the current mirrors sharing a common reference connection or reference input signal. Preferably a current mirror comprises a multiplying digital-to-analogue converter, to provide an output current which is determined by an input (reference) current scaled by a digital value—the digital value determines the mirror ratio. In embodiments the reference current is derived from a reference voltage input by means of a resistor.

In a further aspect the invention provides a. current driver circuit for driving a plurality of electrodes of an OLED display, said driver circuit comprising: at least one control input to receive a control signal; a plurality of drive connections for said plurality of display electrodes; an automatic selector configured to automatically select one of said plurality of drive connections as a first connection and at least one other of said drive connections as a second connection; and a driver configured to provide respective first and second drive signals for said first and second connections, a ratio of said first and second drive signals being controlled in accordance with said control signal.

Preferably the driver comprises at least two current mirrors each having a respective control input, a first of said current mirrors providing said first drive signal, a second of said current mirrors providing said second drive signal, and wherein said automatic selector is configured to automatically select one of said drive connections for providing a reference signal input to both said first and second current mirrors.

In a further aspect the invention provides a selection circuit for controlling current drive in a multi-line addressing OLED display driver, the display having a plurality of row connections for driving a plurality of rows of the display simultaneously, the circuit comprising; an output to output a reference signal for servoing said drive signals to a common reference; and a selector coupled to said plurality of input connections and to said output connection to automatically select a signal from a said input to provide said reference signal.

Preferably the selector selects an output of one of a plurality of current mirrors providing the row connection drive signals to be a common reference for the current mirrors providing drive signals.

The invention also provides an OLED display driver incorporating the above described current drive system, generator or circuits.

BRIEF DESCRIPTION OF THE DRAWINGS

These and other aspects of the of the invention will now be further described, by way of example only, with the reference to the accompanying figures in which.

DETAILED DESCRIPTION OF THE INVENTION

Figure 1A:
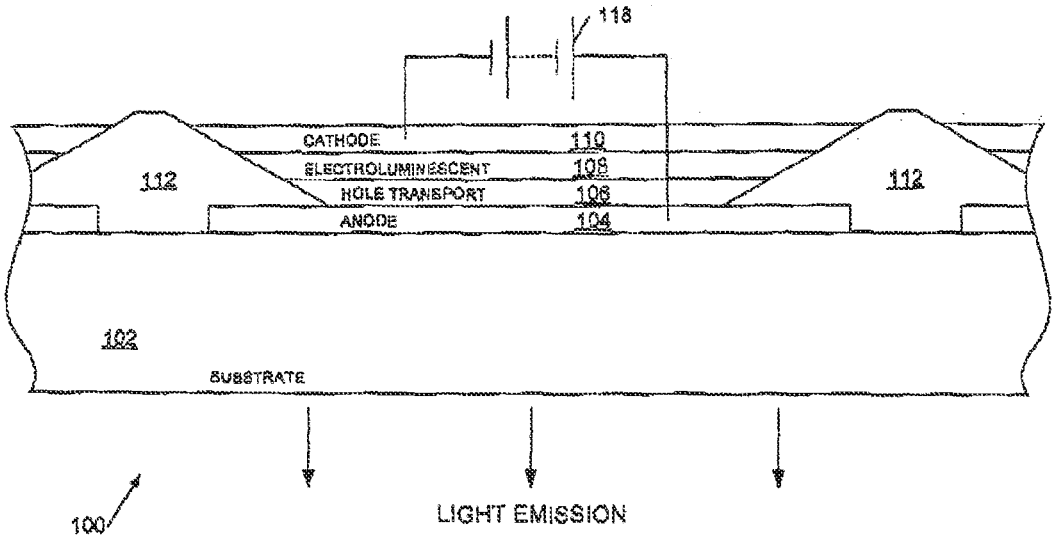
Figure 1a (PRIOR ART)
FIGS. 1*a* and 1*b* show, respectively, a vertical cross section through an OLED device, and a simplified cross section through a passive matrix OLED display.
Figure 1B:
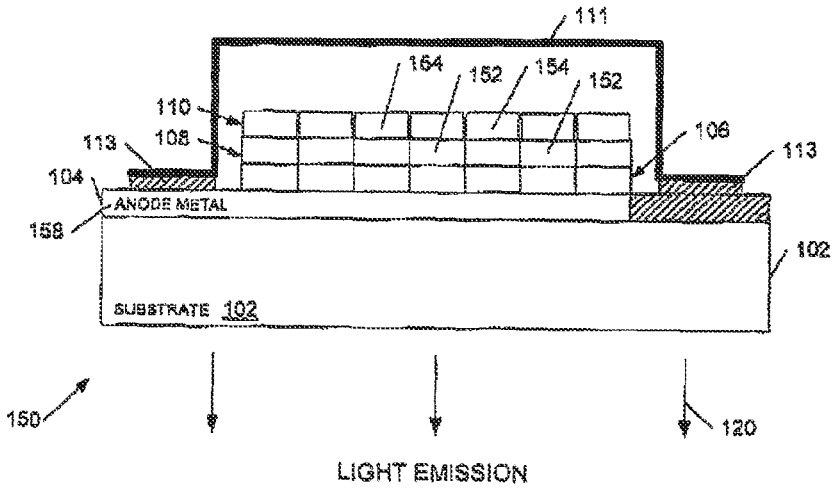
Figure 2:
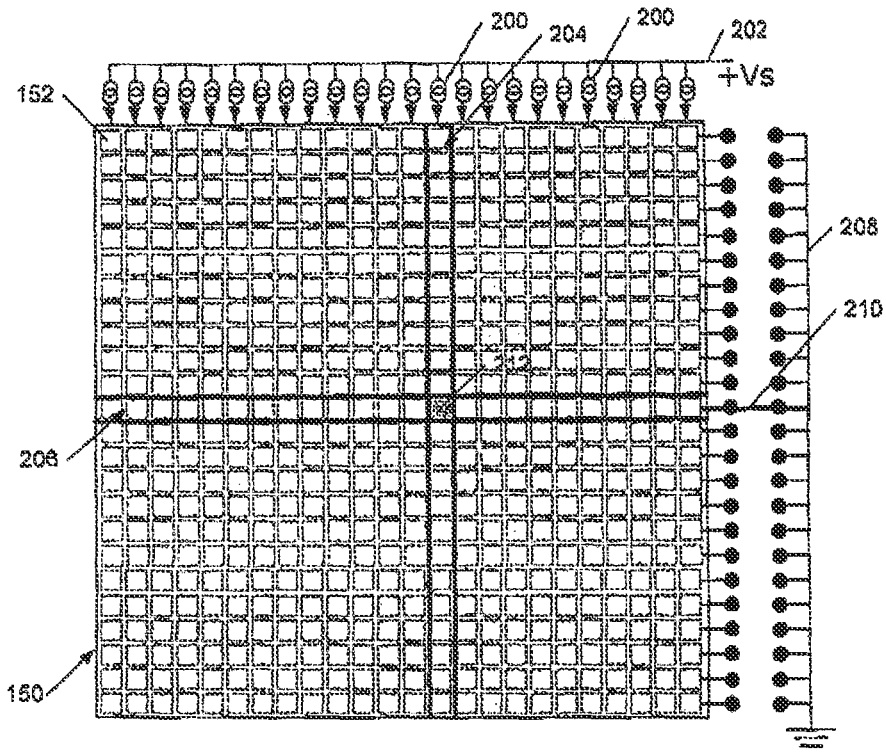
FIG. 2 shows conceptually a driving arrangement for a passive matrix OLED display.

Consider a pair of rows of a passive matrix OLED display comprising a first row A, and a second row B. In a conventional passive matrix drive scheme the rows would be driven as shown in table 1 below, with each row in either a fully-on state (1.0) or a fully-off state (0.0).

TABLE 1

| A | | B | |
|---|---|---|---|
| on | (1.0) | off | (0.0) |
| off | (0.0) | on | (1.0) |

Consider the ratio A/(A+B); in the example of Table 1 above this is either zero or one, but provided that a pixel in the same column in the two rows is not fully-on in both rows this ratio may be reduced whilst still providing the desired pixel luminances. In this way the peak drive level can be reduced and pixel lifetime increased.

In the first line scan the luminances might be:

| First period | | | | |
|---|---|---|---|---|
| 0.0 | 0.361 | 0.650 | 0.954 | 0.0 |
| 0.0 | 0.015 | 0.027 | 0.039 | 0.0 |

-continued

| Second period | | | | |
|---|---|---|---|---|
| 0.2 | 0.139 | 0.050 | 0.046 | 0.0 |
| 0.7 | 0.485 | 0.173 | 0.161 | 0.0 |

It can be seen that:

1. Ratios between the two rows are equal in a single scan period (0.96 for the first scan period, 0.222 for the second).
2. Luminances between the two rows add up to the required values.
3. The peak luminances are equal or less than those during a standard scan.

The example above demonstrates the technique in a simple two line case. If the ratios in the luminance data are similar between the two lines then more benefit is obtained. Depending upon the type of calculations on image data, luminances can be reduced by an average of 30 percent or more, which can have a significant beneficial effect on pixel lifetime Expanding the technique to consider more rows simultaneously can provide greater benefit.

An example of multiline addressing using SVD image matrix decomposition is given. below.

We describe the driving system as matrix multiplication where I is, an image matrix (bit map file), D the displayed image (should be the same as I), R the row drive matrix and C the column drive matrix. The Columns of R describe the drive to the rows in 'line periods' and the Rows or R represent the rows driven. The one row at a time system is thus an identity matrix. For a 6×4 display chequer board display:

$$D(R, C) := R \cdot C$$

$$I := \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$C := 1$$

$$R := \begin{pmatrix} 1 & 0 & 0 & 0 \\ 0 & 1 & 0 & 0 \\ 0 & 0 & 1 & 0 \\ 0 & 0 & 0 & 1 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

which is the same as the image.

Now consider using a two frame drive method:

$$C := \begin{pmatrix} 1 & 0 & 1 & 0 & 1 & 0 \\ 0 & 1 & 0 & 1 & 0 & 1 \end{pmatrix}$$

$$R := \begin{pmatrix} 1 & 0 \\ 0 & 1 \\ 1 & 0 \\ 0 & 1 \end{pmatrix}$$

-continued $$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Again this is the same as the Image matrix.

The drive matrix can be calculated by using Singular Value Decomposition as follows (using MathCad nomenclature):

$X := svd(I^T)$ (gives $U$ and $V$)

$Y := svds(I^T)$ (gives $S$ as a vector of the diagonal elements)

Note Y has only two elements, i.e. two frames:

$$Y = \begin{pmatrix} 2.449 \\ 2.449 \\ 0 \\ 0 \end{pmatrix}$$

$U :=$ submatrix $(X, 0, 5, 0, 3)$ (i.e. top 6 rows)

$V :=$ submatrix $(X, 6, 9, 0, 3)^T$ (i.e. lower 4 rows)

$X =$

| | | | |
|---|---|---|---|
| 0.577 | 0 | 0.816 | 0 |
| 0 | 0.577 | 0 | 0.816 |
| 0.577 | 0 | −0.408 | $4.57 \cdot 10^{-14}$ |
| 0 | 0.577 | 0 | −0.408 |
| 0.577 | 0 | −0.408 | $-4.578 \cdot 10^{-14}$ |
| 0 | 0.577 | 0 | −0.408 |
| 0.707 | 0 | 0.707 | 0 |
| 0 | 0.707 | 0 | −0.707 |
| 0.707 | 0 | −0.707 | 0 |
| 0 | 0.707 | 0 | 0.707 |

$W := diag(Y)$ (i.e. Format $Y$ as a diagonal matrix)

$$W = \begin{pmatrix} 2.449 & 0 & 0 & 0 \\ 0 & 2.449 & 0 & 0 \\ 0 & 0 & 0 & 0 \\ 0 & 0 & 0 & 0 \end{pmatrix}$$

$$D := (U \cdot W \cdot V)^T$$

Checking D:

$$D = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$R := (W \cdot V)^T$$

-continued $$R = \begin{pmatrix} 1.732 & 0 & 0 & 0 \\ 0 & 1.732 & 0 & 0 \\ 1.732 & 0 & 0 & 0 \\ 0 & 1.732 & 0 & 0 \end{pmatrix}$$

(Note the empty last 2 columns)

$R :=$ submatrix $(R, 0, 3, 0, 1)$ (select the non-empty columns)

$$R = \begin{pmatrix} 1.732 & 0 \\ 0 & 1.732 \\ 1.732 & 0 \\ 0 & 1.732 \end{pmatrix}$$

$C := U^T$ $$C = \begin{pmatrix} 0.577 & 0 & 0.577 & 0 & 0.577 & 0 \\ 0 & 0.577 & 0 & 0.577 & 0 & 0.577 \\ 0.816 & 0 & -0.408 & 0 & -0.408 & 0 \\ 0 & 0.816 & 4.57\times10^{-14} & -0.408 & -4.578\times10^{-14} & -0.408 \end{pmatrix}$$

(As we reduced R so C is reduced to top rows only)

$C :=$ submatrix $(C, 0, 1, 0, 5)$ $$C = \begin{pmatrix} 0.577 & 0 & 0.577 & 0 & 0.577 & 0 \\ 0 & 0.577 & 0 & 0.577 & 0 & 0.577 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Which is the same as the desired image.

Now consider a more general case, an image of the letter "A":

$$I := \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

$X := svd(I^T)$ $Y := gvds(I^T)$ (Note Y has only two elements, i.e. three frames)

$$Y = \begin{pmatrix} 2.828 \\ 1.414 \\ 1.414 \\ 0 \end{pmatrix}$$

$U :=$ submatrix $(X, 0, 5, 0, 3)$ $V :=$ submatrix $(X, 6, 9, 0, 3)^T$ $W := diag(Y)$ $D := (U \cdot W \cdot V)^T$ -continued $$D = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

(Checking D)

$R := (W \cdot V)^T$ $$R = \begin{pmatrix} -0.816 & 1.155 & 0 & 0 \\ -0.816 & -0.577 & 1 & 0 \\ -2.449 & 0 & 0 & 0 \\ -0.816 & -0.577 & -1 & 0 \end{pmatrix}$$

(Note empty last columns).

$R :=$ submatrix $(R, 0, 3, 0, 2)$ $$V = \begin{pmatrix} -0.289 & -0.289 & -0.866 & -0.289 \\ 0.816 & -0.408 & 0 & -0.408 \\ 0 & 0.707 & 0 & -0.707 \\ 0.5 & 0.5 & -0.5 & 0.5 \end{pmatrix}$$

$$R = \begin{pmatrix} -0.816 & 1.155 & 0 \\ -0.816 & -0.577 & 1 \\ -2.449 & 0 & 0 \\ -0.816 & -0.577 & -1 \end{pmatrix}$$

$C := U^T$ $$W = \begin{pmatrix} 2.828 & 0 & 0 & 0 \\ 0 & 1.414 & 0 & 0 \\ 0 & 0 & 1.414 & 0 \\ 0 & 0 & 0 & 0 \end{pmatrix}$$

$$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \\ 0.671 & -0.224 & 0 & 0 & 0.224 & -0.671 \end{pmatrix}$$

(As we reduced R so C is reduced to top rows only).

$C :=$ submatrix $(C, 0, 2, 0, 5)$ $$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Which is the same as the desired image.

In this case there are negative numbers in R and C which is undesirable for driving a passive matrix OLED display. By inspection it can be seen that a positive factorisation is possible:

$$R := \begin{pmatrix} 1 & 0 & 0 \\ 0 & 1 & 0 \\ 1 & 1 & 1 \\ 0 & 0 & 1 \end{pmatrix}$$

$$C := \begin{pmatrix} 0 & 0 & 1 & 1 & 0 & 0 \\ 0 & 1 & 0 & 0 & 1 & 0 \\ 1 & 0 & 0 & 0 & 0 & 1 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Non-negative matrix factorization (NMF) provides a method for achieving this in the general case. In non-negative matrix factorization the image matrix I is factorised as:

$$I = W \cdot H \qquad \text{(Equation 3)}$$

Some examples of NMF techniques are described in the following references, all hereby incorporated by reference:

D. D. Lee, H. S. Scung. Algorithms for non-negative matrix factorization ; P. Paatero, U. Tapper. Least squares formulation of robust non-negative factor analysis. Chemometr. Intell. Lab. 37 (1997), 23-35; P. Paatero. A weighted non-negative least squares algorithm for three-way 'PARAFAC' factor analysis. Chemometr. Intell. Lab. 38 (1997), 223-242; P. Paatero, P. K. Hopke, etc. Understanding and controlling rotations in factor analytic models. Chemometr. Intell. Lab 60 (2002), 253-264; J. W. Demmel. Applied numerical linear algebra. Society for Industrial and Applied Mathematics, Philadelphia. 1997; S. Juntto, P. Paatero, Analysis of daily precipitation data by positive matrix factorization. Environmetrics, 5 (1994), 127-144; P. Paatero, U. Tapper. Positive matrix factorization: a non-negative factor model with optimal utilization of error estimates of data values. Environmetrics, 5 (1994), 111-126; C. L. Lawson, R. J. Hanson. Solving least squares problems. Prentice-Hall, Englewood Cliffs, N.J., 1974; Algorithms for Non-negative Matrix Factorization, Daniel D. Lea, H. Sebastian Seung, pages 556-562, Advances in Neural Information Processing Systems 13, Papers from Neural Information Processing Systems (NIPS) 2000, Denver, Colo., USA. MIT Press 2001; and Existing and New Algorithms for Non-negative Matrix Factorization By Wenguo Liu & Jianliang Yi (www.dcfl.gov/DCCI/rdwg/nmf.pdf; source code for the algorithms discussed therein can be found at http://www.cs.utexas.edu/users/liuwg/383CProject/CS_383C_Project.htm).

Figure 9A:
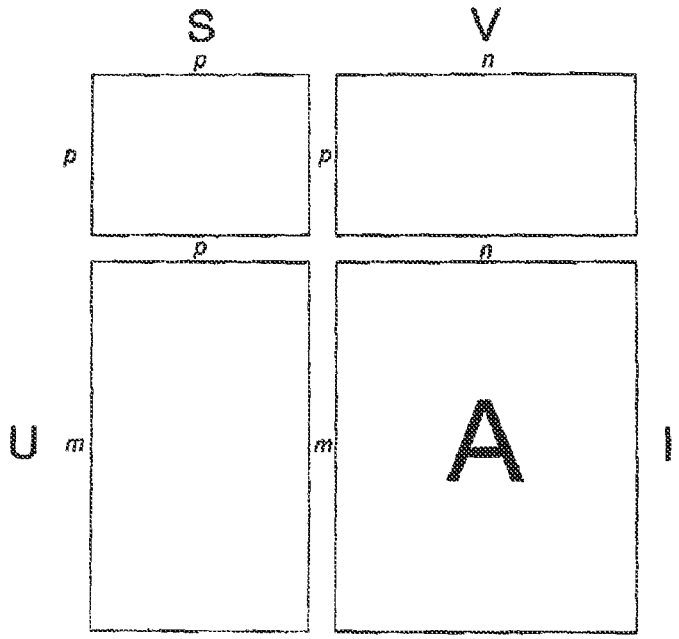
FIGS. 9*a* and 9*b* show, respectively, SVD and NMF factorisation of an image matrix.
Figure 9B:
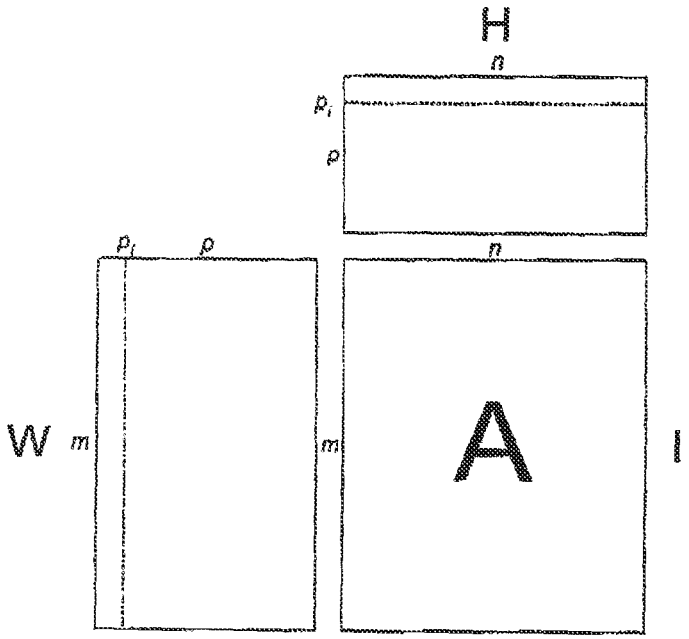

The NMF factorise/ion procedure is diagrammatically illustrated in FIG. 9*b*.

Once the basic above-described scheme has been implemented other techniques can be used for additional benefit. For example duplicate rows of pixels, which are not uncommon in Windows (trademark) type applications, can be written simultaneously to reduce the number of line periods, hence shortening the frame period and reducing the peak brightness required for the same integrated brightness. Once an SVD decomposition has been obtained the lower rows with only small (drive) values can be neglected as they are of decreasing significance to the quality of the final image. As described above the multi-line addressing technique described above is applied within a single displayed frame but it will be recognised that a luminescence profile of one or more rows may be built up over the time dimension additionally or alternatively to a spatial dimension. This may be facilitated by moving picture compression techniques in which between-frame time interpolation is employed.

Embodiments of the above MLA techniques are particularly useful in colour OLED displays, in which case the techniques are preferably employed for groups of red (R), green (G), and blue (B) sub-pixels as well as, optionally, between pixel rows. This is because images tend to contain blocks of similar colour, and because a correlation between R, G and B sub-pixel drives is often higher than between separate pixels. Thus in embodiments of the scheme rows for multi-line addressing are grouped into R, G, and B rows with three rows defining a complete pixel and an image being built up by selecting combinations of the R, G and B rows simultaneously. For example if a significant area of the image to be displayed is white the image can be built up by first selecting groups of R, G and B rows together while applying appropriate signals to the column drivers.

Application of the MLA scheme to a colour display has a further advantage. In a conventional colour OLED display a row of pixels has the pattern "RGBRGB . . . " so that when the row is enabled separate column drivers can simultaneously drive the R, G and B sub-pixels to provide a full colour illuminated pixel. However the three rows may have the configuration "RRRR . . . ", "GGGG . . . ", "BBBB . . . ", a single column addressing R, G and B sub-pixels. This configuration simplifies the application of an OLED display since a row of, say, red pixels may be (inkjet) printed in a single long trough (separated from adjacent troughs by the cathode separator) rather than separate "wells" being required to define regions for the three different coloured materials in each row. This enables the elimination of a fabrication step and also increases the pixel aperture ratio (that is the percentage of display area occupied by active pixel). Thus in a further aspect the invention provides a display of this type.

Figure 4A:
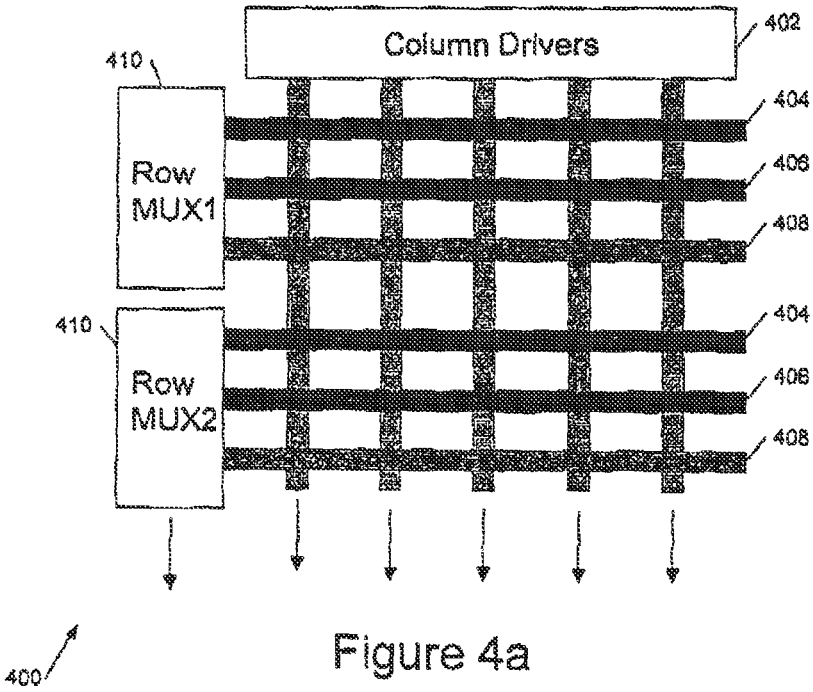
FIGS. 4*a* to 4*c*, show respectively, block diagrams of first and second examples of display driver hardware for implementing an MLA addressing scheme for a colour OLED display, and a timing diagram for such a scheme.

FIG. 4*a* shows a block diagram of an example display/driver hardware configuration 400 for such a scheme. As can be seen a single column driver 402 addresses rows of red 404, green 406 and blue 408 pixels. Permutations of red, green and blue rows are addressed using row selectors/multiplexers 410 or, alternatively, by means of a current sink controlling each row as described further later. It can be seen from FIG. 4*a* that this configuration allows red, green and blue sub-pixels to be printed in linear troughs (rather than wells) each sharing a common electrode. This reduces substrate patterning and printing complexity and increases aperture ratio (and hence indirectly lifetime through the reduced drive necessary). With the physical device layout of FIG. 4*a* a number or different MLA drive schemes may be implemented.

In a first example drive scheme an image is built up by addressing groups of rows in sequence as shown below:

1. White component: R, G, and B are selected and driven together
2. Red+Blue driven together
3. Blue+Green driven together
4. Red+Green driven together
5. Red only
6. Blue only
7. Green only Only the necessary colour steps are carried out to build up the image using the minimum number of colour combinations. The combinations may be optimised to increase lifetime and/or reduce power consumption, depending on the requirement of the application.

In an alternative colour MLA scheme, the driving of the ROB rows is split into three line scan periods, with each line period driving one primary. The primaries are combinations of R G and B chosen to form a colour gamut which encloses all the desired colours along a line or row of the display:

In one method the primaries are R+aG=aB, G+bR+bB, B+cR+cG where 0>=a,b,c>=1 and a, b and c are chosen to be the largest possible values (a+b+c=maximum) while still enclosing all desired colours within their colour gamut.

In another method a, b and c are chosen in a scheme to best improve the overall performance of the display. For example, if blue lifetime is a limiting factor, a and b may be maximised at the expense of c; if red power consumption is a problem, b and c can be maximised. This is because the total emitted brightness should equal a fixed value. Consider an example where b=c=0. In this case the red brightness must be fully achieved in the first scan period. However if b,c>0 then the red brightness is built up more gradually over multiple scan periods, thus reducing the peak brightness and increasing the red subpixel lifetime and efficiency.

In another variation the length of the individual scan periods can be adjusted to optimise lifetime or power consumptions (for example to provide increased scan time).

In a further variation the primaries may be chosen arbitrarily, but to define the minimum possible colour gamut which still encloses all colours on a line of the display. For example in an extreme case, if there were only shades of greens on a reproducible colour gamut.

Figure 4B:
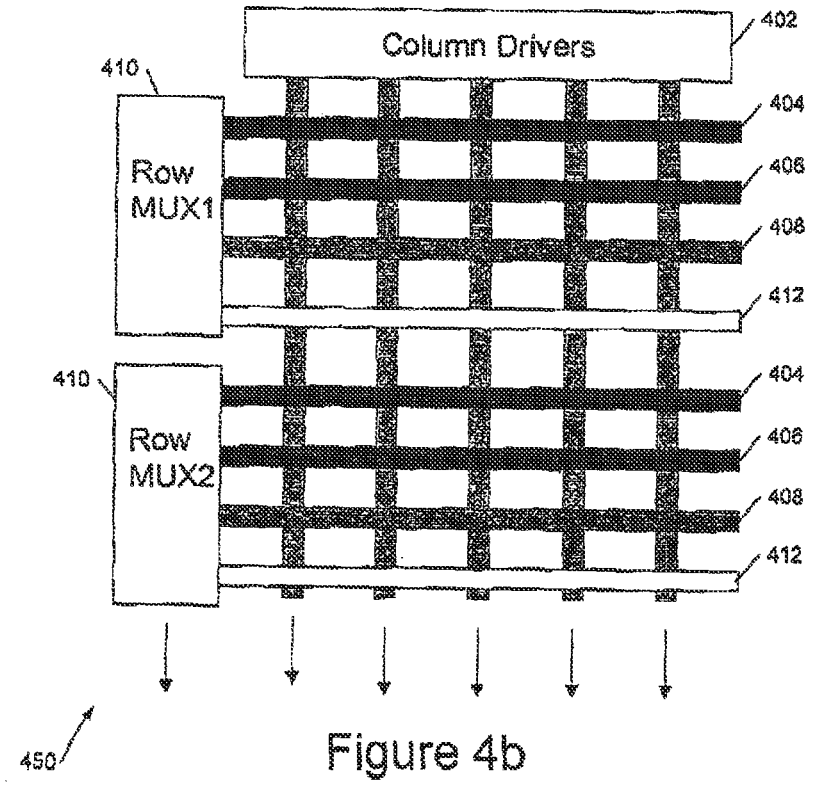

FIG. 4*b* shows a second example of display driver hardware 450 in which like elements to those in FIG. 4*a* are shown by like reference numerals. In FIG. 4*b* the display includes additional rows of white (W) pixels 412 which are also used to build up a colour image when driven in combination with three primaries.

The inclusion of white sub-pixels broadly speaking reduces the demands on the blue pixels thus increasing display lifetime; alternatively, depending on the drive scheme, power consumption for display of given colour may be reduced. Colours other than white, for example magenta, cyan, and/or yellow emitting sub-pixels may be included, for example to increase the colour gamut. The different coloured sub-pixels need not have the same area.

As illustrated in FIG. 4*b* each row comprises sub-pixels of a single colour, as described with reference to FIG. 4*a*, but it will be appreciated that a conventional pixel layout may also be employed with successive R, G, B and W pixels along each row. In this case the columns will be driven by four separate column drivers, one for each of the four colours.

It will be appreciated that the above described multi-line addressing schemes may be employed in connection with the display/driver arrangement of FIG. 4*b*, with combinations of R, G, B and W rows being addressed in different permutations and/or with different drive ratios, either using row multiplexers (as illustrated) or a current sink for each line. As described above an image is built up by successively driving different combinations of rows.

As outlined above and described in more detail below, some preferred drive techniques employ a variable current drive to the OLED display pixels. However a simpler drive scheme, which has no need for row current mirrors, may be implemented using one or more row selectors/multiplexers to select rows of the display singularly and in combination in accordance with the first example colour display drive scheme given above.

Figure 4C:
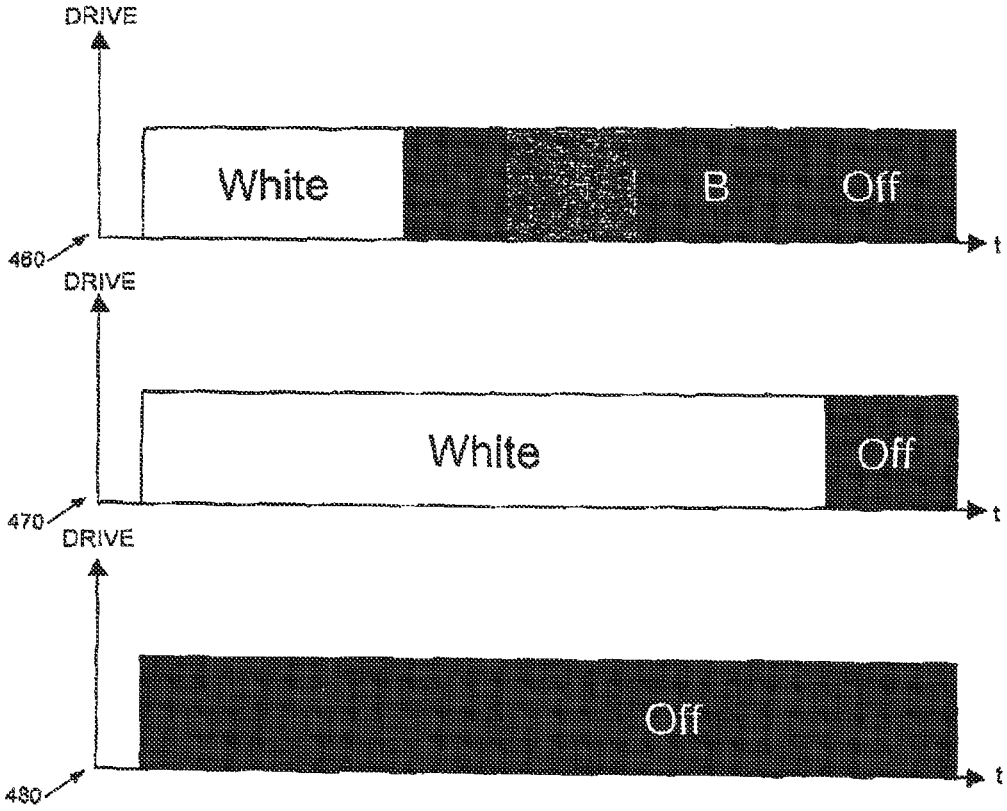

FIG. 4*c* illustrates the timing of row selection in such a scheme. In a first period 460 white, red, green and blue rows are selected and driven together; in a second period 470 white only is driven, and in a third period 480 red only is driven, all according to a pulse-width modulation drive timing.

Driver Systems

Figure 5A:
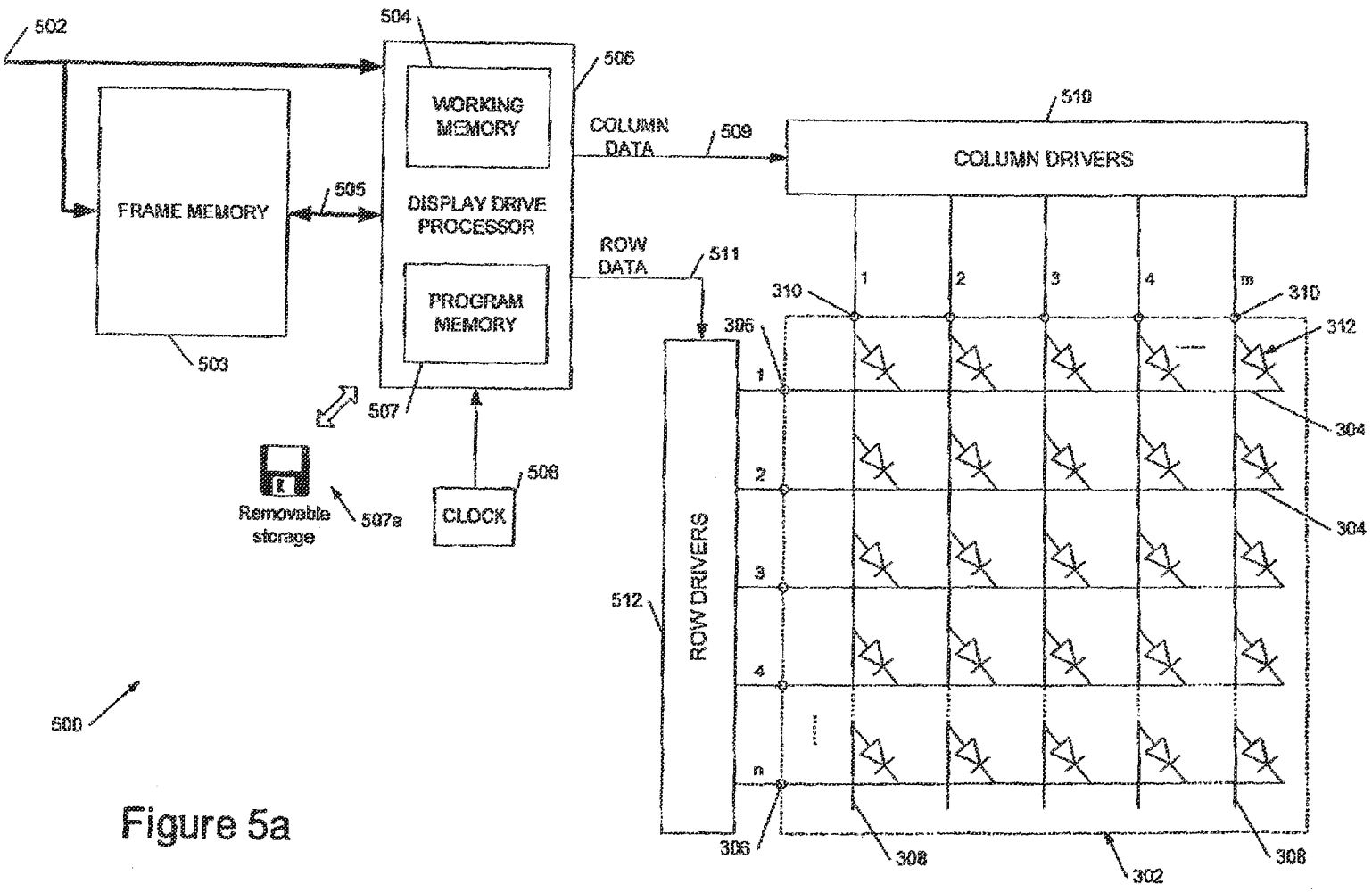
FIGS. 5*a* to 5*m* show, respectively, an MLA display driver, column and row drivers, example digital-to-analogue current converters for the display driver of FIG. 5*a*, a programmable current mirror, a second programmable current mirror, block diagrams of current mirrors according to the prior art, a driver system employing a plurality of current mirrors, embodying an aspect of the present invention, a selection circuit, a control circuit, a selection circuit variant, a current mirror incorporating a multiplying DAC, and an OLED display driver.

Referring next to FIG. 5*a*, this shows a schematic diagram of a passive matrix OLED driver 500 which implements an MLA addressing scheme as described above.

Figure 3:
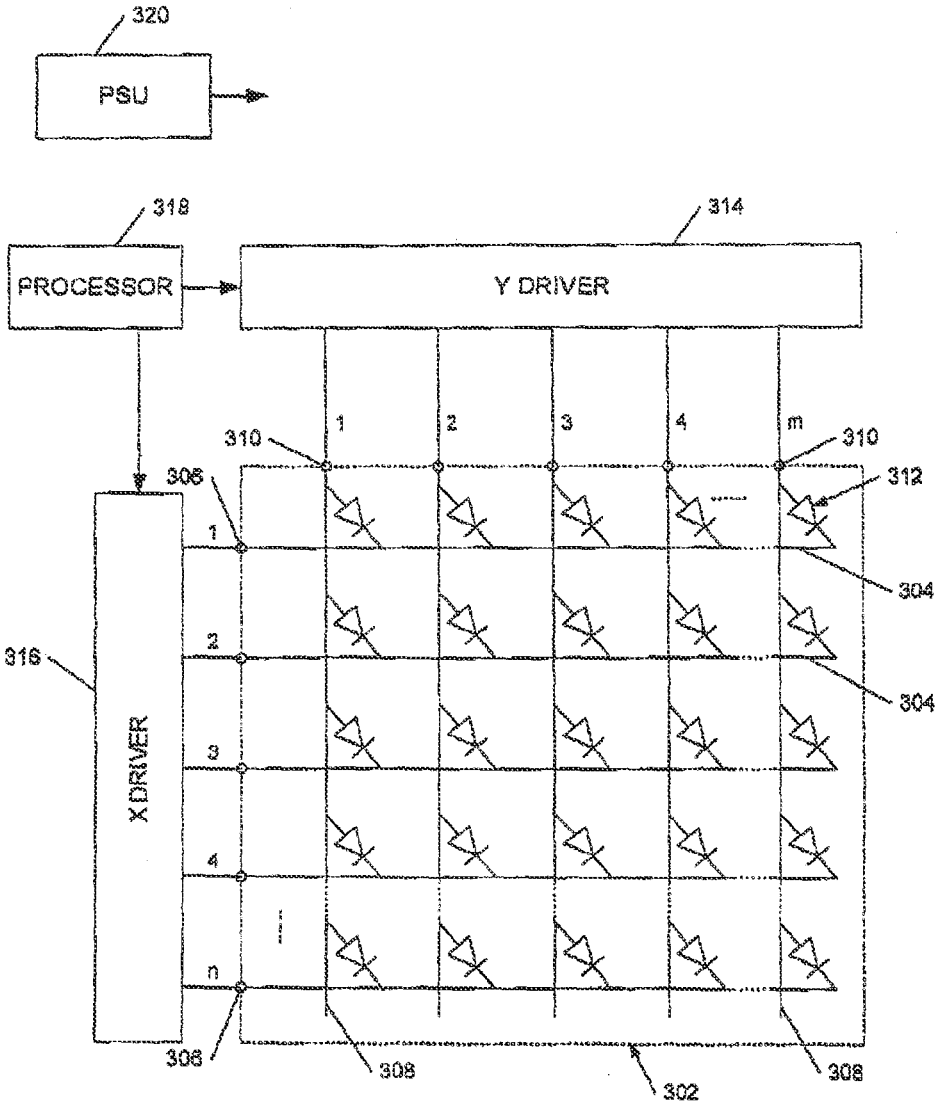
Figure 3 (PRIOR ART)
FIG. 3 shows a block diagram of a known passive matrix OLED display driver.
Figure 5B:
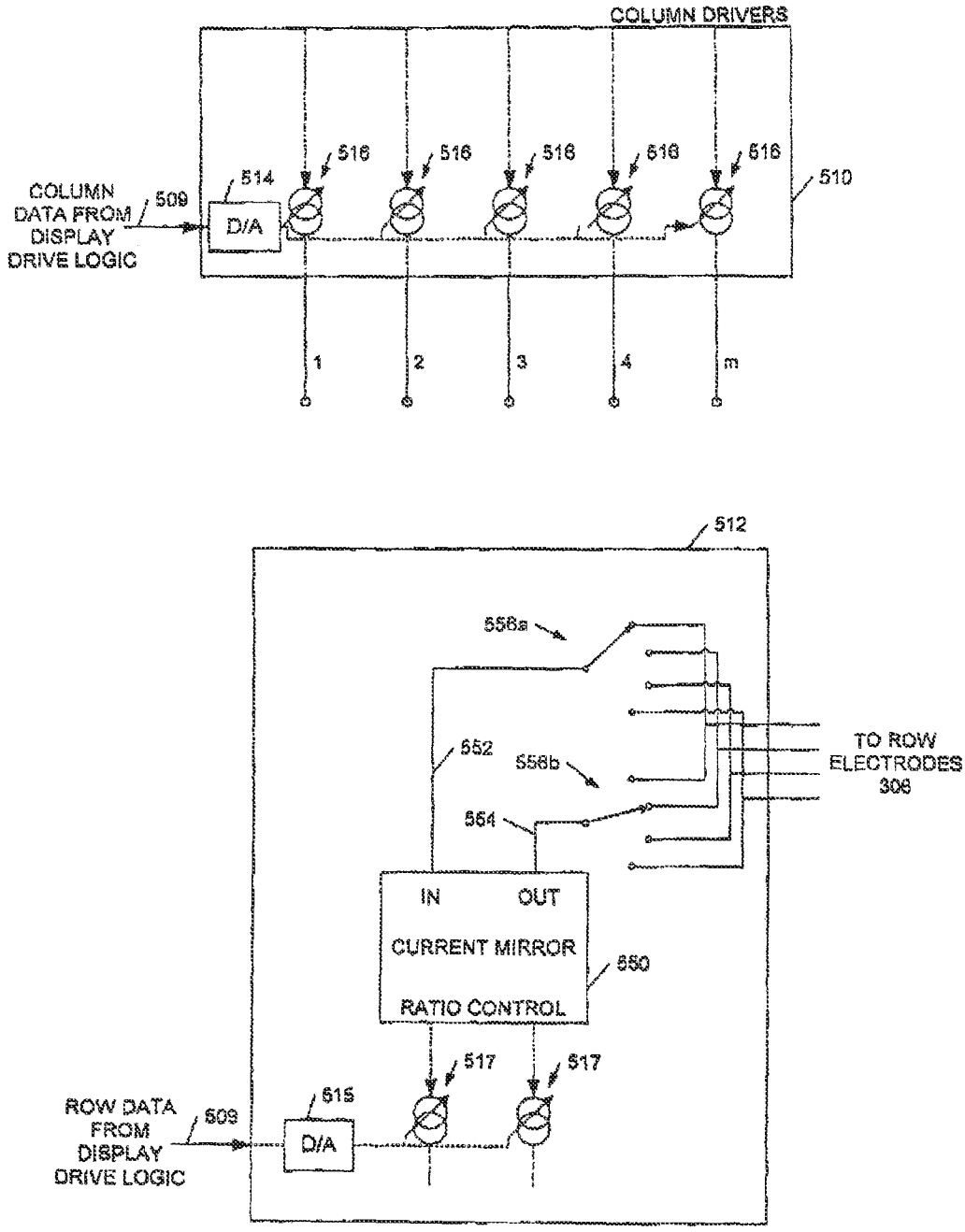

In FIG. 5*a* a passive matrix OLED display similar to that described with reference to FIG. 3 has row electrodes 306 driven by row driver circuits 512 and column electrodes 310 driven by column drives 510. Details of these row and column drivers are shown in FIG. 5*b*. Column drivers 510 have a column data input 509 for setting the current drive to one or more of the column electrodes; similarly row drivers 512 have a row data input 511 for setting the current drive ratio to two or more of the rows. Preferably inputs 509 and 511 are digital inputs for ease of interfacing; preferably column data input 509 sets the current drives for all the m columns of display 302.

Data for display is provided on a data and control bus 502, which may be either serial or parallel. Bus 502 provides an input to a frame store memory 503 which stores luminance data for each pixel of the display or, in a colour display, luminance information for each sub-pixel (which may be encoded as separate RGB colour signals or as luminance and chrominance signals or in some other way). The data stored in frame memory 503 determines a desired apparent brightness for each pixel (or sub-pixel) for the display, and this information may be read out by means of a second, read bus 505 by a display drive processor 506 (in some arrangements bus 505 may be omitted and bus 502 used instead).

Display drive processor 506 may be implemented entirely in hardware, or in software using, say, a digital signal processing core, or in a combination of the two, for example, employing dedicated hardware to accelerate matrix operations. Generally, however, display drive processor 506 will be at least partially implemented by means of stored program code or micro code stored in a program memory 507, operating under control of a clock 508 and in conjunction with working memory 504. Code in program memory 507 may be provided on a data carrier or removable storage 507*a*.

The code in program memory 507 is configured to implement one or more of the above described multi-line addressing methods using conventional programming techniques. In some configurations these methods may be implemented using a standard digital signal processor and code running in any conventional programming language. In such an instance a conventional library of DSP routines may be employed, for example, to implement singular value decomposition, or dedicated code may be written for this purpose, or other configurations not employing SVD may be implemented such as the techniques described above with respect to driving colour displays.

Figure 5C:
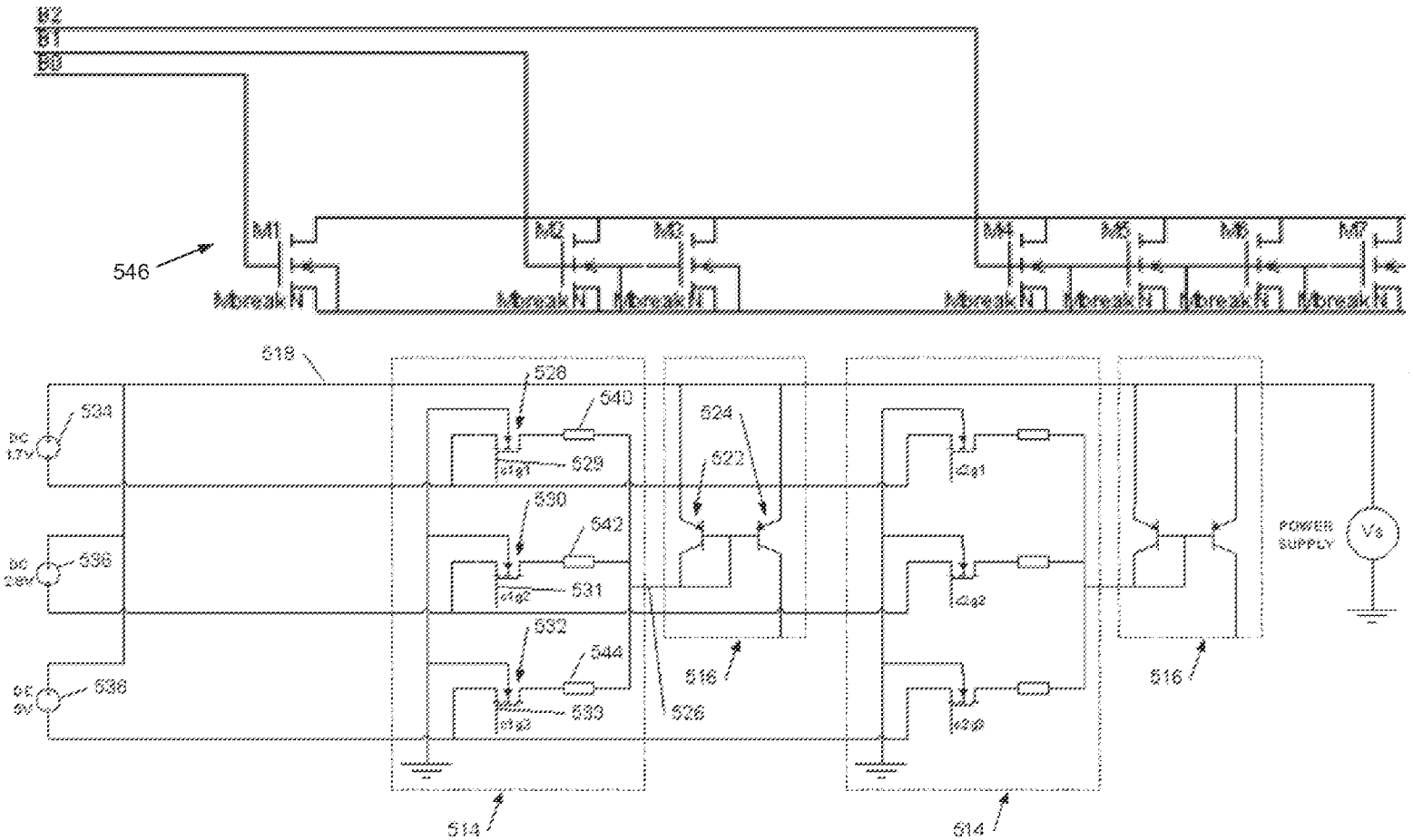

Referring now to FIG. 5*b*, this shows details of the column 510 and row 512 drivers of FIG. 5*a*. The column driver circuitry 510 includes a plurality of controllable reference current sources 516, one for each column line, each under control of respective digital-to-analogue converter 514. Details of example implementations of these are shown in FIG. 5*c* where it can be seen that a controllable current source 516 comprises a pair of transistors 522, 524 connected to a power line 518 in a current mirror configuration. Since, in this example, the column drivers comprise current sources these are PNP bipolar transistors connected to a positive supply line; to provide a current sink NPN transistors connected to ground are employed; in other arrangements MOS transistors are used. The digital-to-analogue converters 514 each comprise a plurality (in this instance three) of FET switches 528, 530, 532 each connected to a respective power supply 534, 536, 538. The gate connections 529,531, 533 provide a digital input switching the respective power supply to a corresponding current set resistor 540, 542, 544, each resistor being connected to a current input 526 of a current mirror 516. The power supplies have voltages scaled in powers of two, that is each twice that of the next lowest power supply less a $V_{gs}$ drop so that a digital value on the FET gate connections is converted into a corresponding current on a line 526; alternatively the power supplies may have the same voltage and the resistors 540, 542, 544 may be scaled. FIG. 5*c* also shows an alternative D/A controlled current source/sink 546; in this arrangement where multiple transistors are shown a single appropriately-sized larger transistor may be employed instead.

The row drivers 512 also incorporate two (or more) digitally controllable current sources 515, 517, and these may be implemented using similar arrangements to those shown in FIG. 5*c*, employing current sink rather than current source mirrors. In this way controllable current sinks 517 may be programmed to sink currents in a desired ratio (or ratios) corresponding to a ratio (or ratios) of row drive levels. Controllable current sinks 517 are thus coupled to a ratio control current mirror 550 which has an input 552 for receiving a first, referenced current and one or more outputs 554 for receiving (sinking) one or more (negative) output currents, the ratio of an output current to the input current being determined by a ratio of control inputs defined by controllable current generators 517 in accordance with row data on line 509, Two row electrode multiplexers 556*a, b* are provided to allow selection of one row electrode to provide a reference current and another row electrode to provide an "output" current; optionally further selectors/multiplexers 556*b* and mirror outputs from 550 may be provided. As illustrated row driver 512 allows the selection of two rows for concurrent driving from a block of four row electrodes but in practice alternative selection arrangements may be employed—for example in one arrangement twelve rows (one reference and eleven mirrors) are selected from 64 row electrodes by twelve 64 way multiplexers; in another arrangement the 64 rows may be divided into several blocks each having an associated row driver capable of selecting a plurality of rows for simultaneous driving.

Figure 5D:
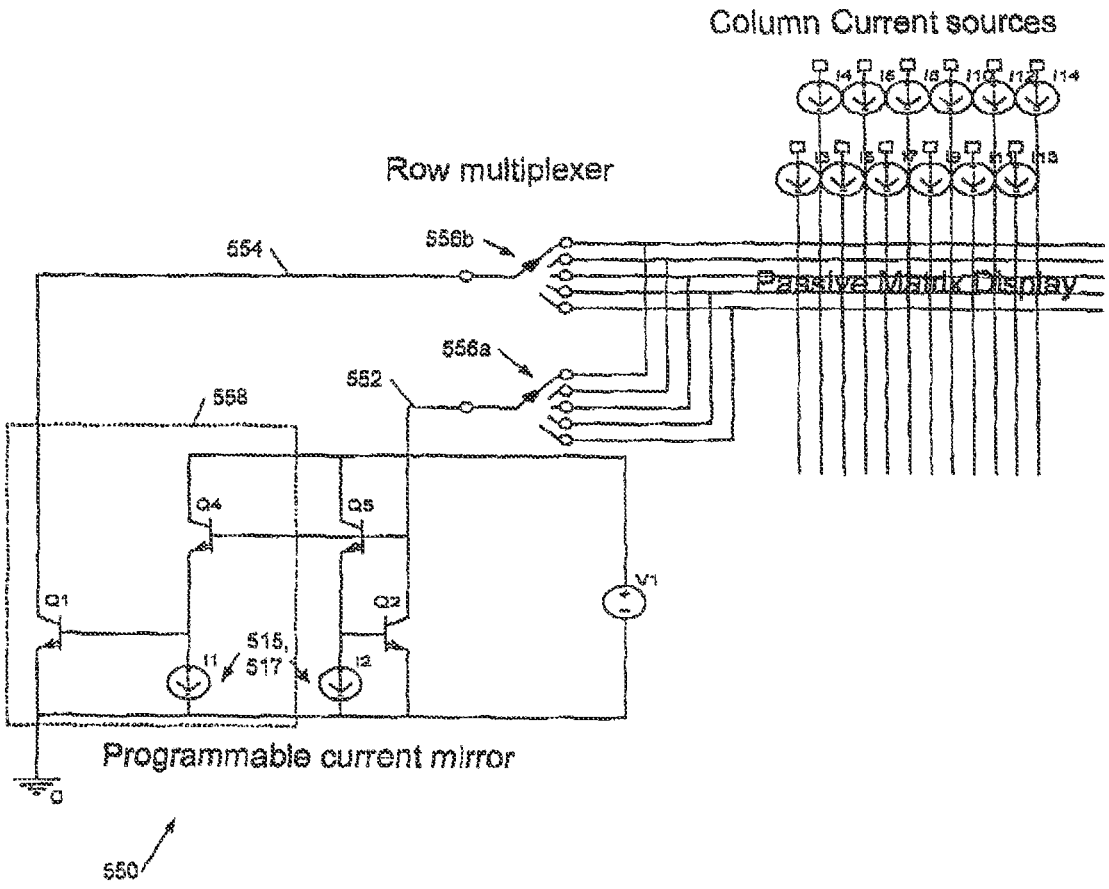

FIG. 5*d* shows details of an implementation of the programmable ratio control current mirror 550 of FIG. 5*b*. In this example implementation a bipolar current mirror with a so-called beta helper (Q5) is employed, but the skilled person will recognise that many other types of current mirror circuit may also be used. In the circuit of FIG. 5*d* V1 is a power supply of typically around 3V and I1 and I2 define the ratio of currents in the collectors of Q1 and Q2. The currents in the two lines 552, 554 are in the ratio I1 to I2 and thus a given total column current is divided between the two selected rows in this ratio. The, skilled person will appreciate that this circuit can be extended to an arbitrary number of mirrored rows by providing a repeated implementation of the circuitry within dashed line 558.

Figure 5E:
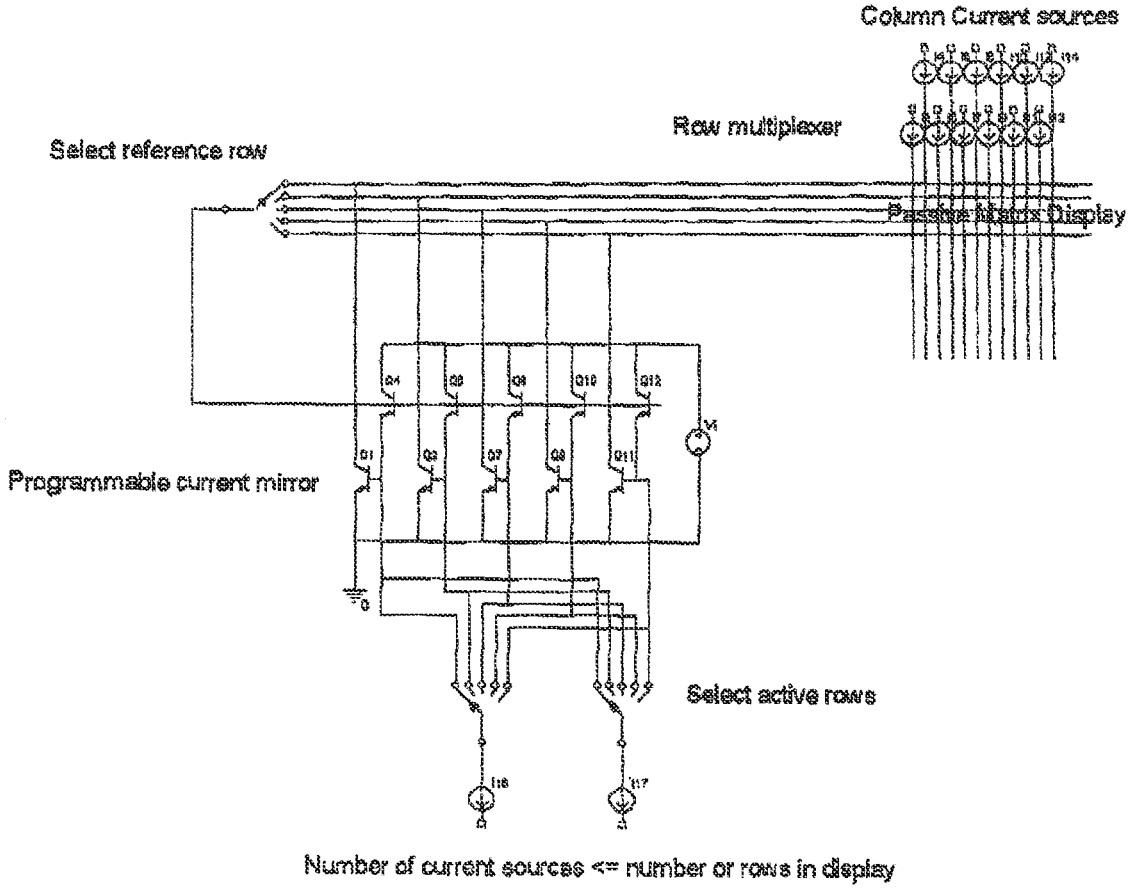

FIG. 5*e* illustrates an alternative programmable current mirror for the row driver 512 of FIG. 5*b*. In this alternative each row is provided with circuitry corresponding to that within dashed line 558 of FIG. 5*d*, that is with a current mirror output stage, and then one or more row selectors connects selected ones of these current mirror output stages to one or more respective programmable reference current supplies (source or sink). Another selector selects a row to be used as a reference input to the current mirror.

In the above-described row drivers row selection need not be employed since a separate current mirror output may be provided for each row either of the complete display or for each row of a block of rows of the display. Where row selection is employed rows may be grouped in blocks—for example where a current mirror with three outputs is employed with selective connection to, say a group of 12 rows, sets of three successive rows may be selected in turn to provide three-line MLA for the 12 rows. Alternatively rows may be grouped using a priori knowledge relating to the line image to be displayed, for example where it is known that a particular sub-section of the image would benefit from MLA because of the nature of the displayed data (significant correlation between rows).

Figure 5F:
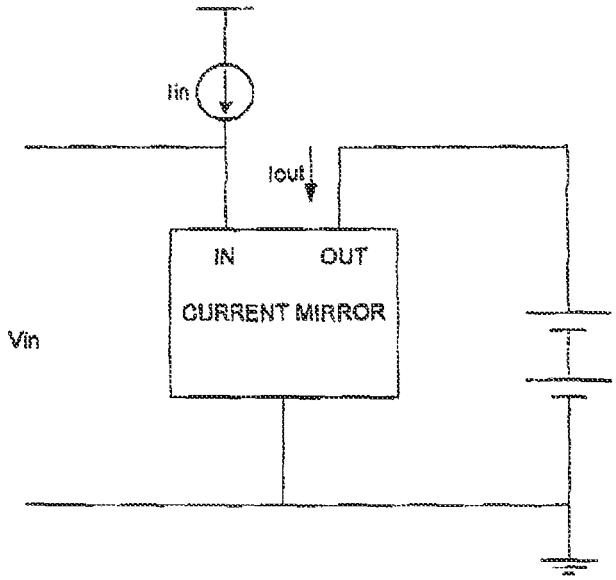
Figure 5f (PRIOR ART)
Figure 5G:
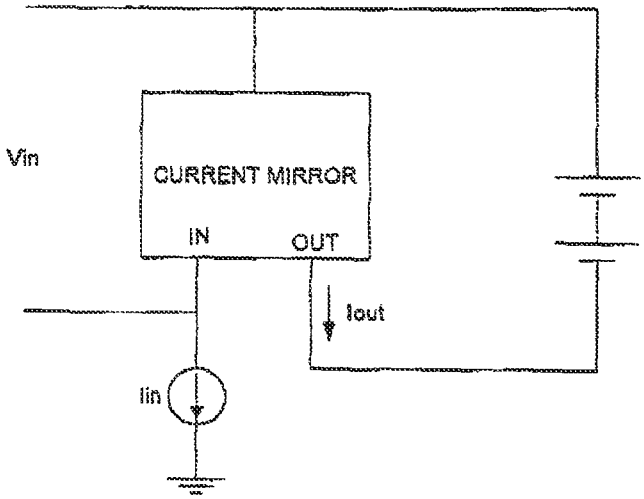
Figure 5g (PRIOR ART)

FIGS. 5*f* and 5*g* illustrate current mirror configurations according to the prior art with, respectively, a ground reference and a positive supply reference, showing the sense of the input and output currents. It can be seen that these currents are both in the same sense but maybe either positive or negative.

Automatic Row Selection

We next describe some techniques for, in effect, automatic row selection.

Figure 5H:
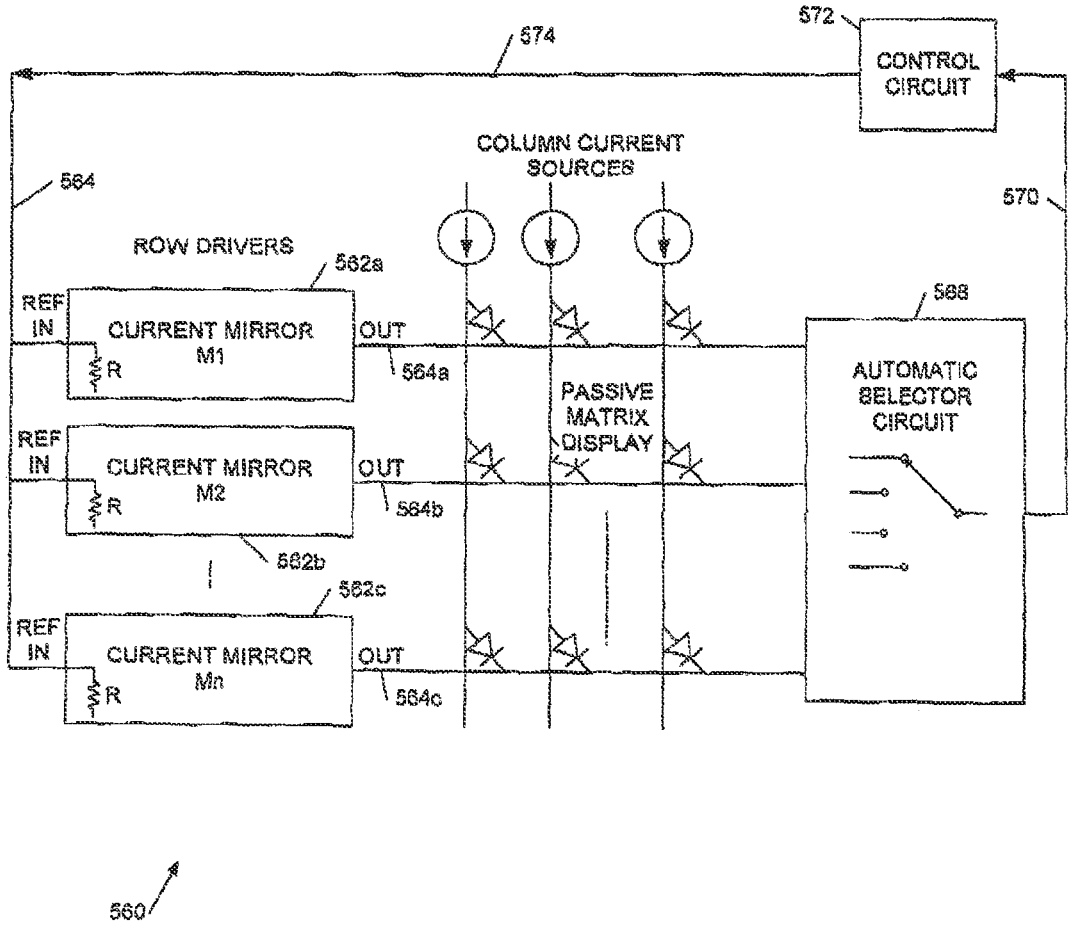

A first of these techniques is schematically illustrated in FIG. 5*h* which shows, broadly speaking, a driver system 560 employing a plurality of current mirrors 562*a-c* sharing a common reference signal input 564 (in fact a voltage signal converted to a reference current by internal Resistors) and a plurality of respective outputs 566*a-c* driving rows of the display. A negative feedback arrangement is employed to select the output 566 (that is, a row drive signal) which is at a lowest potential, closest to a (positive or negative) supply line (which includes ground where, say, the supply is between zero and a positive voltage rather than bipolar). This selection is performed. by an analogue circuit 568 which has an output 570 which is dependent upon the minimum (or maximum) row drive voltage, in embodiments being equal to this voltage less a $V_{gs}$ drop. This output 570 provides an input to a control circuit 572, in embodiments an amplifier such as a common base amplifier or an operational amplifier, which in turn provides an output 574 coupled to the common reference signal input 564 of the current mirrors 562.

In operation the voltage output on line 574 is controlled such that the reference signal input 564 to current mirrors 562 is at a level which is "correct" for the current mirror output selected by selection circuit 568, by means of a negative feedback loop. More particularly the negative feedback ensures that the reference input to the selected current mirror is at a level which is consistent with the voltage on the selected row drive line when the selected line is driven by an output current (source or sink) determined by scaling of the reference by the mirror ratio of the (selected) current mirror.

Figure 5J:
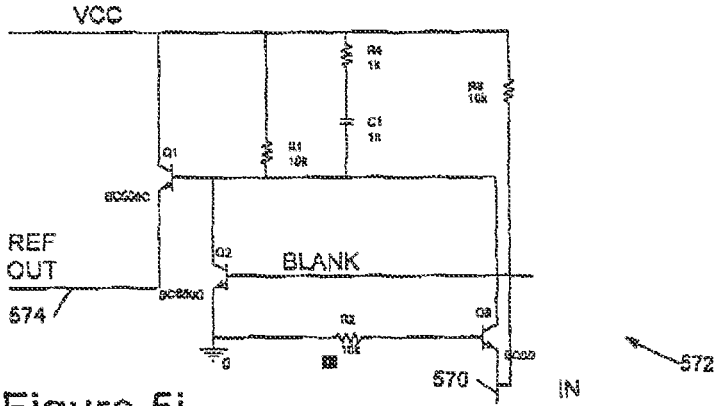
Figure 5L:
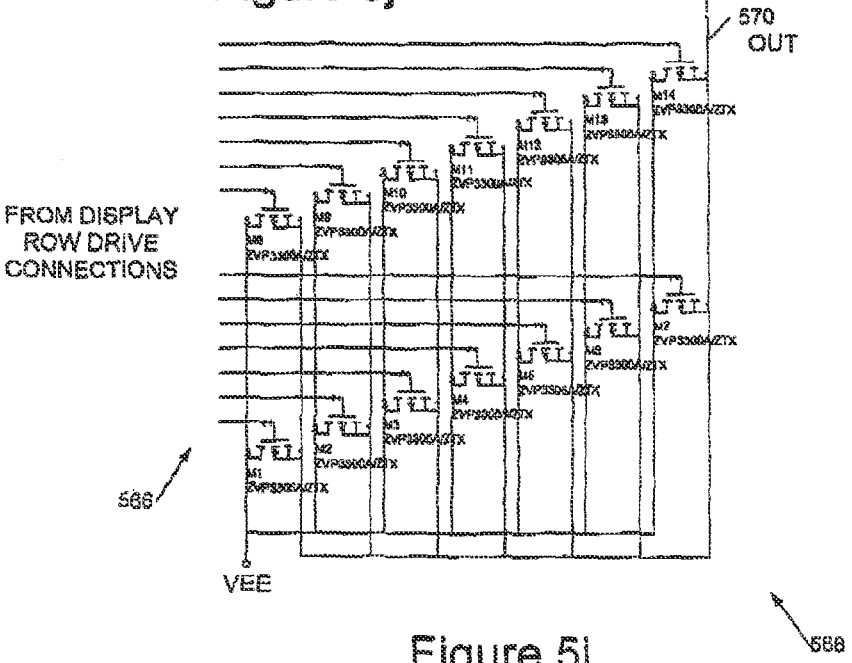
Figure 5K:
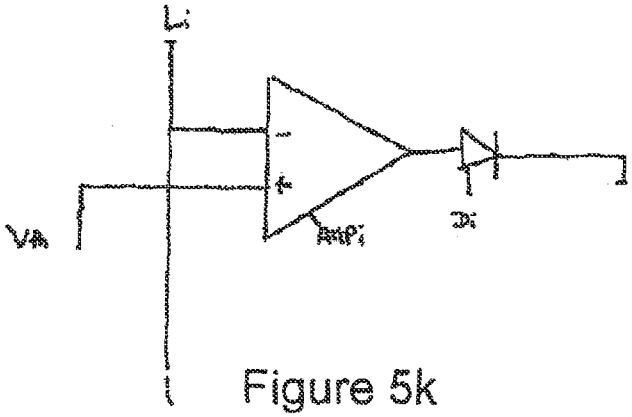
Figure 5I:
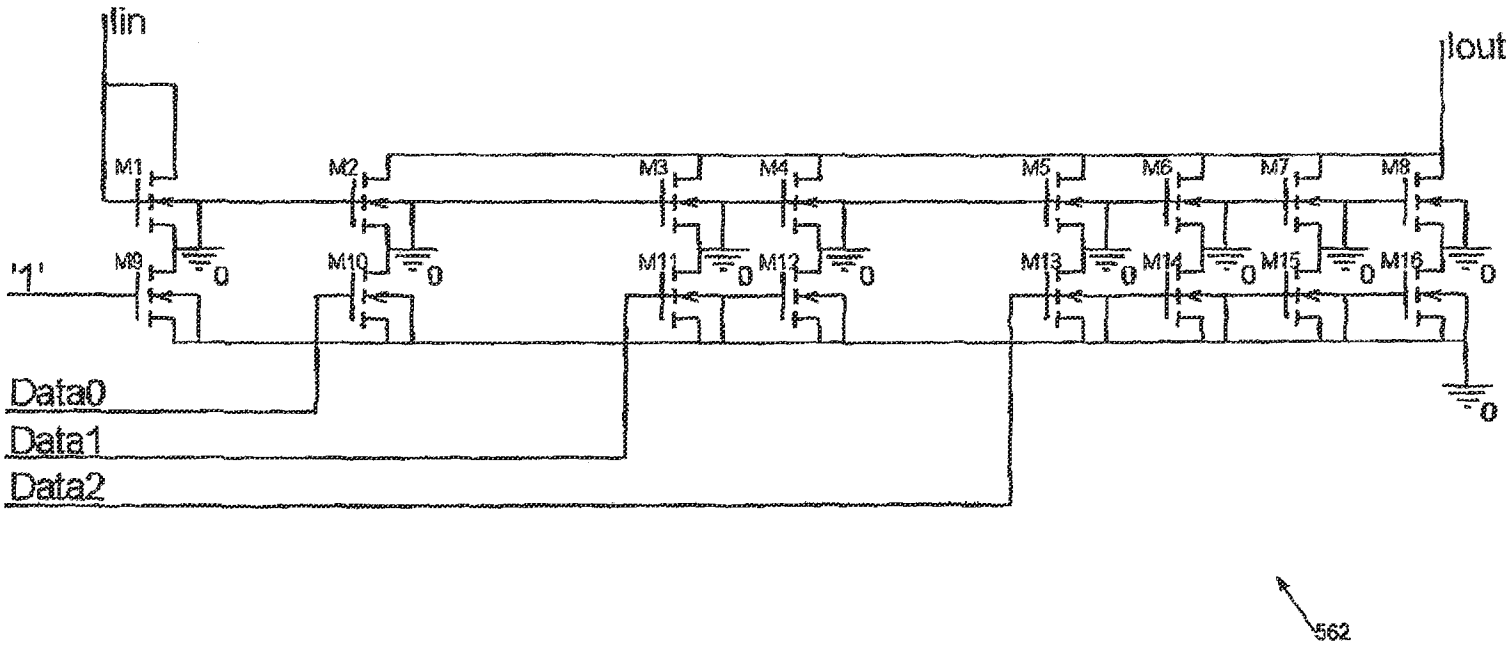

Referring now to FIG. 5*i*, this shows details of an example selection circuit 568, in this embodiment comprising a plurality of PMOS transistors to select the lowest (most negative) row drive line voltage; to select a maximum (most positive) voltage NMOS transistors may be employed. As can be seen the gate of each transistor provides an input to the selector circuit, all the drains of the transistors are connected together, to $V_{EE}$, a negative supply, and all the sources of the transistors are connected together to provide output 570. It can be seen, by inspection, that the lowest (most negative) gate voltage will turn one of the transistors on pulling it's source, and hence output 570, to one gate-source voltage above the input voltage $V_g$. This pulls the source connections of the other transistors to the same (lowest) voltage which effectively turns off all the other transistors. In practice the transition is abrupt so that generally only one transistor is on and the other transistors are substantially off. Although there is a region, for example, where two or more input connections are substantially the same potential, where two or more of the transistors may be partially on. In practice this has little effect because the control circuit as a whole is controlling using the lowest potential and the difference in potential when a signal transistor is on and when two transistors at substantially the same voltage are on is minimal.

FIG. 5*j* shows an example of control circuit 572, in this case comprising a common base amplifier providing an output voltage on line 574 which is converted to an output current within each of the respective current mirrors 562 of FIG. 5*h*. Considering again the negative feedback loop of FIG. 5*h* consider an example where, say, the selected row voltage is −0.8 volts (the voltage at the emitter of transistor Q3 of FIG. 5*j*, the base of which is at 0 volts). If too much current is sunk by the row mirror driver then this input voltage becomes more negative which results in a lower potential on output 574 of the circuit of FIG. 5*j*, thus reducing the current into the reference current input of the selected mirror circuit until the imbalance is corrected.

FIG. 5*l* shows an example current mirror 562, which in preferred embodiments comprises a multiplying DAC, with each bit of a digital input controlling a binary weighted output stage portion of the mirror circuit.

Figure 5M:
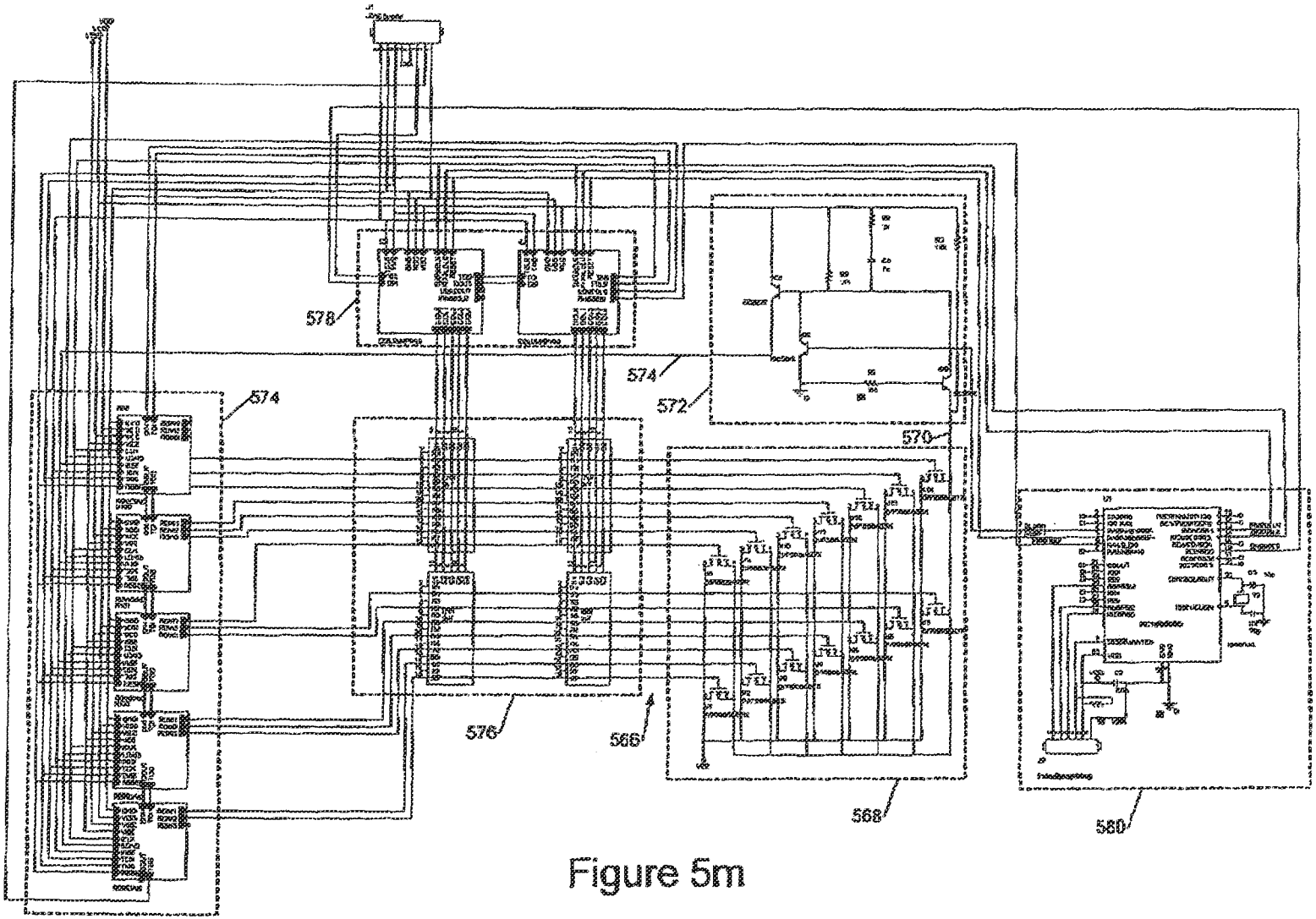

FIG. 5*m* shows, in outline, a complete schematic of an OLED display driver incorporating the above described selection system. This Figure shows row drivers 574 incorporating the current mirrors 562, connections to a passive matrix OLED display 576, column drivers 578, the selection circuit 568, the control circuit 572, and a controller 580.

To summarise, whereas in the arrangements of FIGS. 5*b* to 5*e* a multipole switch is used to balance current in the row drivers to that of the column drivers by selecting the row moat likely to reach the compliance limit of the driver, in the implementation described with reference to FIGS. 5*h* to 5*l* a "minimum" function automatically selects the row which is nearest its compliance limit. This avoids the need for the display drive controller to select which row to use as a reference when controlling the absolute value of the row driver currents. This reduces the controller complexity and helps to ensure that no row driver reaches its compliance limit. In embodiments the rectifying function of a set of a transistors (M1 to M14 in FIG. 5*i*) is used to transmit the minimum of a set of input (row) signals to output 570. This signal is then amplified (by transistors Q1 and Q3 in FIG. 5*j*) and used to control the reference current to the row drivers 574 (R99-R103 in FIG. 5*l*).

We next describe an alternative embodiment of the above system.

In the arrangement of FIG. 5*i* the selection circuit 568 comprises a plurality of transistors in a source follower configuration, their source connections connected together in common to output 570, which functions as a voltage node. In an alternative arrangement the sources of the transistors are connected together to a positive supply such as a $V_{CC}$ supply and the drains of the transistors are connected together to output line 570, which functions as a current node (the output current is the sum of the current through each transistor). This configuration works in a slightly different way to the source follower configuration. With the source follower configuration output 570 is coupled to a non-inverting amplifier but in the alternative configuration we now describe an inverting amplifier is employed.

As the skilled person will understand a MOS transistor only begins to turn on when the gate voltage is different from the source voltage by greater than a threshold voltage. Assume that the current mirror DACs are initially provided with a small reference (current) so that many of the row drive connections are at a relatively high voltage and substantially all of the transistors are off. As there is an inverter in the feedback loop the reference current begins to rise until one of the transistors starts turning on; this is the transistor with a lowest (most negative) gate voltage (or more generally the transistor with the gate voltage most different from the common source voltage). This transistor starts passing current and the feedback loop ensures that the DAC is controlled to the appropriate reference current level. This alternative arrangement is less preferable than the source follower arrangement because when the gate-source voltages of multiple transistors are close more than one transistor can be on (and the output current summed), which can alter the reference voltage on a row drive connection (this can be a little higher than if just one transistor is on) and which can increase the loop gain, reducing stability. In the source follower configuration, however, as one transistor turns on it tends to turn the rest of the transistors off.

In a still farther variant a transistor in the selection circuit 568 of FIG. 5*i* may be replaced by an operational amplifier as shown in FIG. 5*k*. Each amplifier has an inverting input connection to a display row drive connection (Li), a non-inverting input connected to a reference voltage (Vth) and the output of the amplifiers are connected together in common by means of respective diodes (Di).

Figure 6:
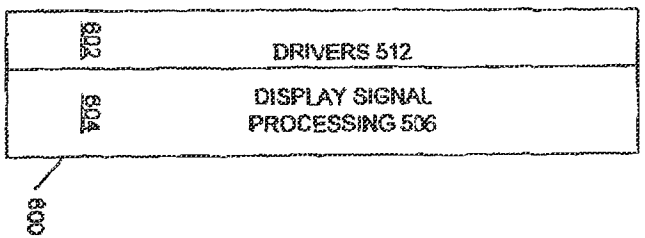
FIG. 6 shows, a layout of an integrated circuit die incorporating multi-line addressing display signal processing circuitry and driver circuitry.

FIG. 6 shows a layout of an integrated circuit die 600 combining the row drivers 512 and display drive processor 506 of FIG. 5*a*. The die has the shape of an elongated rectangle, of example dimensions 20 mm×1 mm, with a first region 602 for a long line of driver circuitry comprising repeated implementations of substantially the same set of devices, and an adjacent region 604 used to implement the MLA display processing circuitry. Region 604 would otherwise be unused space since there is a minimum physical width to which a chip can be diced.

MLA Drive Schemes

The above described MLA display drivers employ a variable current drive to control OLED luminance but the skilled person will recognise that other means of varying the drive to an OLED pixel, in particular PWM, may additionally or alternatively employed.

Figure 7:
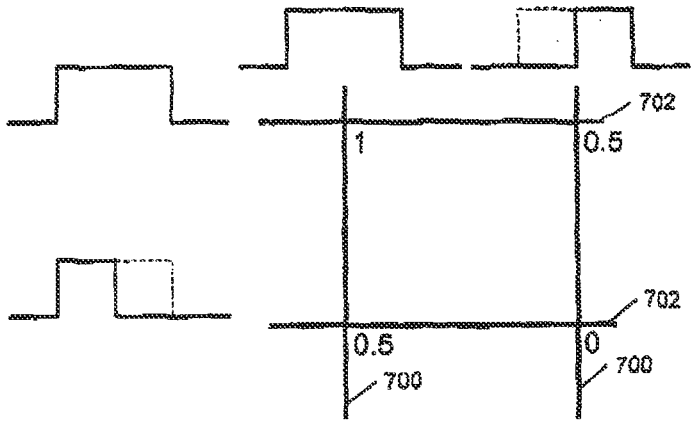
FIG. 7 shows a schematic illustration of a pulse width modulation MLA drive scheme.

FIG. 7 shows a schematic illustration of a pulse width modulation drive scheme for multi-line addressing, In FIG. 7 the column electrodes 700 are provided with a pulse width modulated drive at the same time as two or more row electrodes 702 to achieve the desired luminance patterns. In the example of FIG. 7 the zero value shown could be smoothly varied up to 0.5 by gradually shifting the second row pulse to a later time; in general a variable drive to a pixel may be applied by controlling a degree of overlap of row and column pulses.

Some preferred MLA methods employing matrix factorisation will now be described in more detail.

Figure 8A:
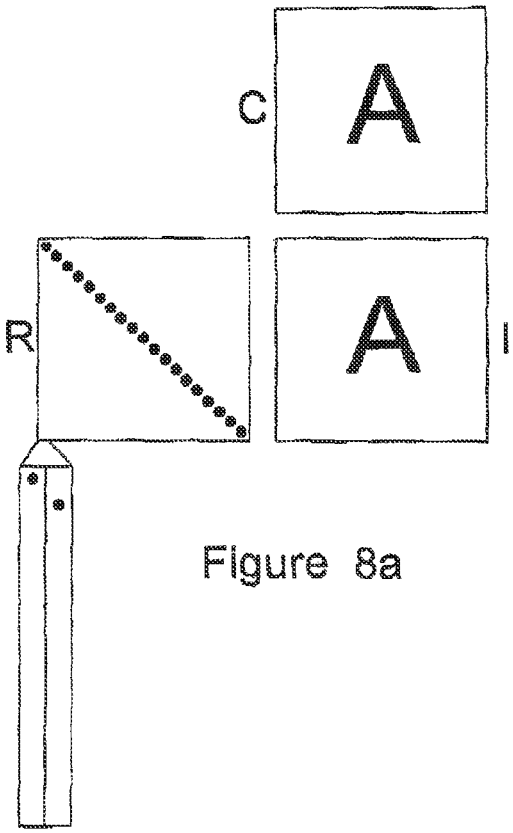
FIGS. 8*a* to 8*d* show row, column and image matrices for a conventional drive scheme and for a multiline addressing drive scheme respectively, and corresponding brightness curves for a typical pixel over a frame period.
Figure 8B:
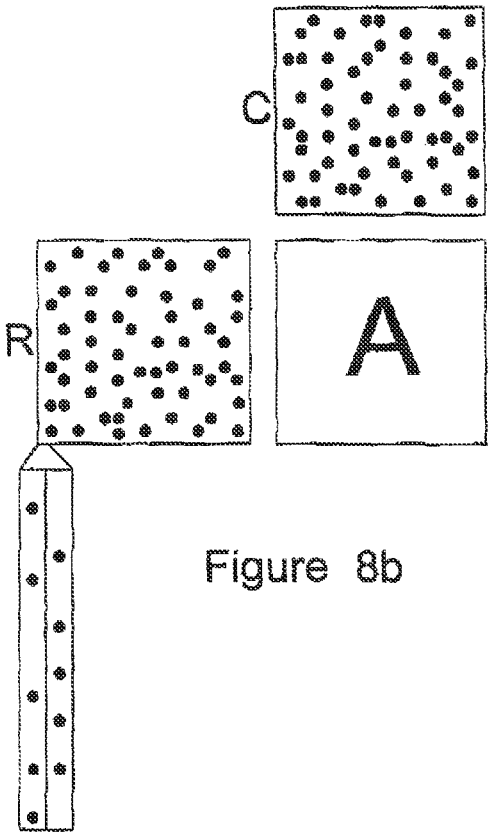
Figure 8C:
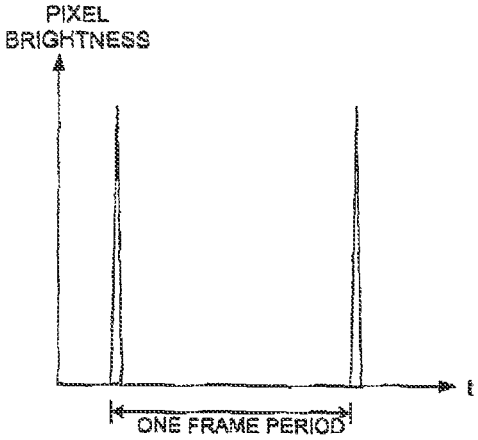
Figure 8D:
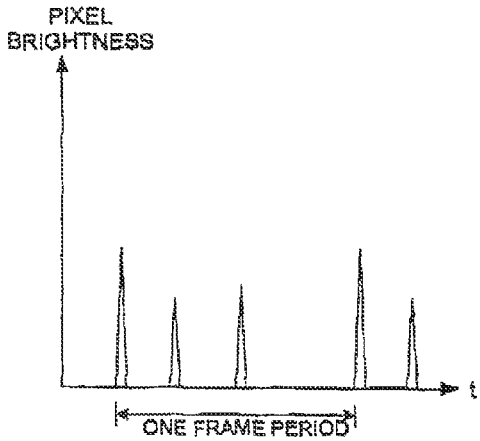

Referring to FIG. 8*a*, this shows row R, column C and image I matrices for a conventional drive scheme in which one row is driven at a time. FIG. 8*b* shows row, column and image matrices for a multiline addressing scheme. FIGS. 8*c* and 8*d* illustrate, for a typical pixel of the displayed image, the brightness of the pixel, or equivalently the drive to the pixel, over a frame period, showing the reduction in peak pixel drive which is achieved through multiline addressing.

FIG. 9*a* illustrates, diagrammatically, singular value composition (SVD) of an image matrix I according to Equation 2 below:

$$\underset{m\times n}{I} = \underset{m\times p}{U} \times \underset{p\times p}{S} \times \underset{p\times n}{V} \qquad \text{Equation 2}$$

The display can be driven by any combination of U, S and V, for example driving rows US and columns with V or driving rows with $U\sqrt{S}$ and column with $\sqrt{S}.V$ other related techniques such as QR decomposition and LU decomposition can also be employed. Suitable numerical techniques are described in, for example, "Numerical Recipes in C: The Art of Scientific Computing", Cambridge University Press 1992; many libraries of program code modules also include suitable routines.

Figure 10:
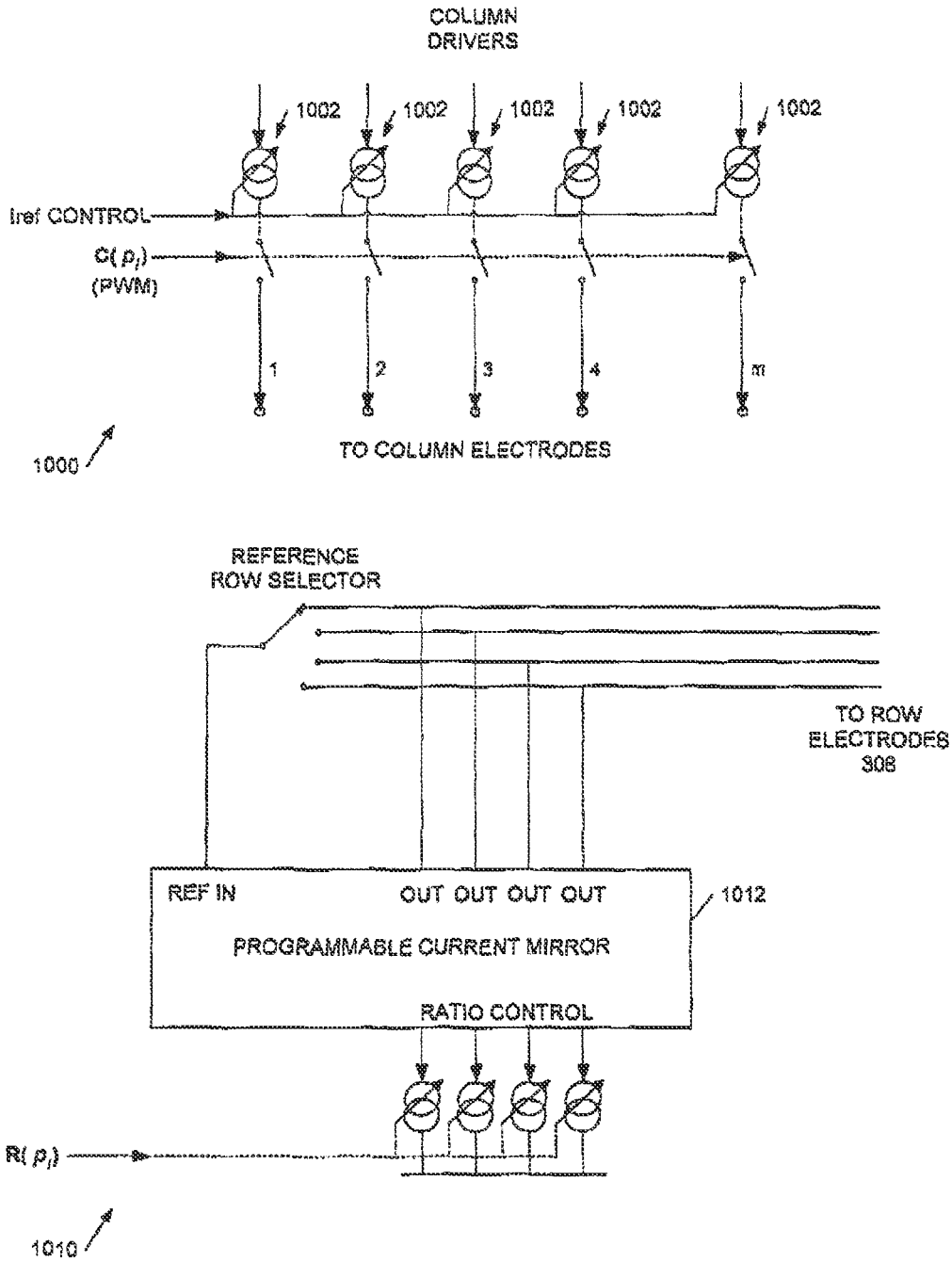
FIG. 10 shows example column and row drive arrangements for driving a display using the matrices of FIG. 9.

FIG. 10 illustrates row and column drivers similar to those described with reference to FIGS. 5*b* to 5*e* and suitable for driving a display with a factorised image matrix. The column drivers 1000 comprise a set of adjustable substantially constant current sources 1002 which are ganged together and provided with a variable reference current $I_{ref}$ for setting the current into each of the column electrodes. This reference current is pulse width modulated by a different value for each column derived from a row of a factor matrix such as row $p_i$ of matrix H of FIG. 9*b*. The row drive 1010 comprises a programmable current mirror 1012 similar to that shown in FIG. 5*e* but preferably with one output for each row of the display or for each row of a block of simultaneously driven rows. The row drive signals are derived from a column of a factor matrix such as column $p_i$ of matrix W of FIG. 9*b*.

Figure 11:
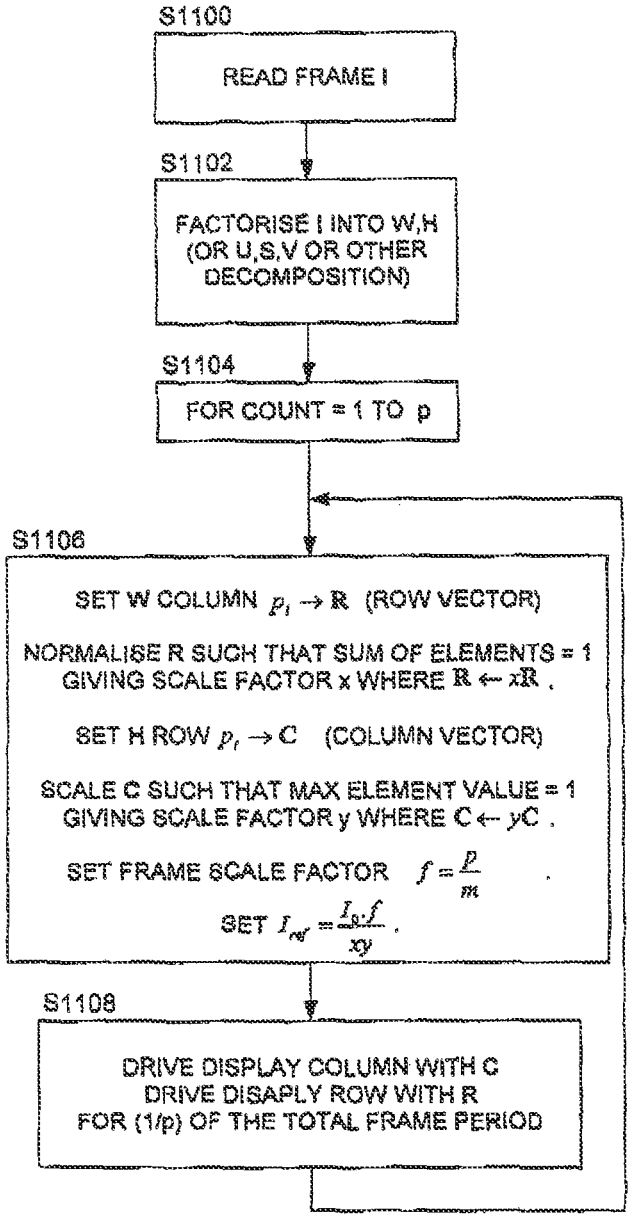
FIG. 11 shows a flow diagram for a method of driving a display using image matrix factorisation.

FIG. 11 shows a flow diagram of an example procedure for displaying an image using matrix factorisation such as NMF, and which may be implemented in program code stored in program memory 507 of display drive processor 506 of FIG. 5*a*.

In FIG. 11 the procedure first reads the frame image matrix I (step S1100), and then factorises this image matrix into factor matrices W and H using NMF, or into other factor matrices, for example U, S and V when employing SVD (step S1102). This factorisation may be computed during display of an earlier frame. The procedure then drives the display with p subframes at step 1104. Step 1106 shows the subframe drive procedure.

The subframe procedure sets W-column $p_i \rightarrow R$ to form a row vector R. This is automatically normalised to unity by the row driver arrangement of FIG. 10 and a scale factor x, $R \leftarrow xR$ is therefore derived by normalising R such that the sum of elements is unity. Similarly with H, row $p_i \rightarrow C$ to form a column vector C. This is scaled such that the maximum element value is 1, giving a scale factor y, $C \leftarrow yC$. The a frame scale factor $$f = \frac{p}{m}$$

is determined and the reference current set by $$I_{ref} = \frac{I_0 \cdot f}{xy}$$

where $I_0$ corresponds to the current required for full brightness in a conventionally scanned line at a time system, the x and y factors compensating for scaling effects introduced by the driving arrangement (with other driving arrangements one or both of these may be omitted).

Following this, at step S1108, the display drivers shown in FIG. 10 drive the columns of the display with C and rows of the display with R for 1/p of the total frame period. This is repeated for each subframe and the subframe data for the next frame is then output.

Figure 12:
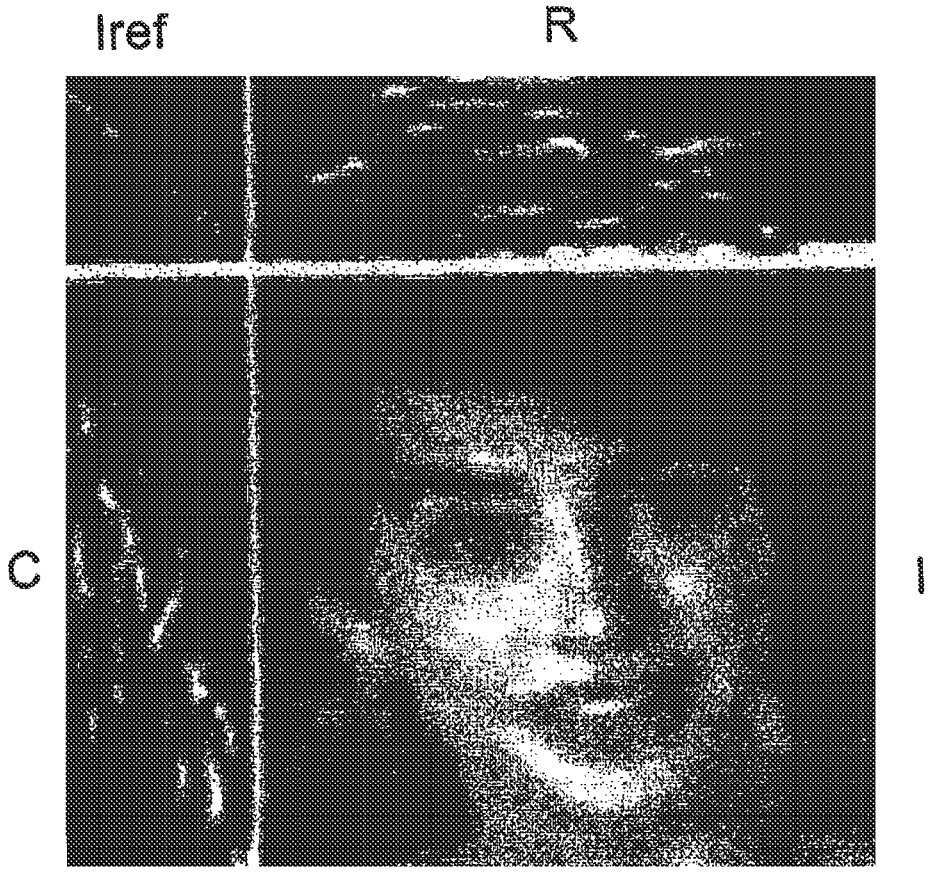
FIG. 12 shows an example of a displayed image obtained using image matrix factorisation.

FIG. 12 shows an example of an image constructed in accordance with an embodiment of the above described method; the format corresponds to that of FIG. 9*b*. The image in FIG. 12 is defined by a 50×50 image matrix which, in this example, is displayed using 15 subframes (p=15). The number of subframes can be determined in advance or varied according to the nature of the image displayed.

The image manipulation calculations to be performed are not dissimilar in their general character to operations performed by consumer electronic imaging devices such as digital cameras and embodiments of the method may be conveniently implemented in such devices.

In other embodiments the method can be implemented on a dedicated integrated circuit, or by means of a gate array, or in the software on a digital signal processor, or in some combination of these.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A current drive system for an electroluminescent display, said system for multi-line addressing said display, the system comprising:

a plurality of current mirrors having a plurality of outputs for driving a plurality of drive electrodes of said display, each said current mirror having a reference signal input and arranged to scale the reference signal input according to a mirror ratio determined by the current mirror; and an automatic selector coupled to said current mirror outputs to automatically select from said current mirror outputs including a said current mirror output of a first said current mirror a said current mirror output for providing reference signal inputs to said current mirrors including said first current mirror, wherein said reference signal inputs of said current mirrors are coupled together to provide a common reference signal input, and wherein said automatic selector has an output coupled to said common reference signal input, wherein said selector is configured to select a said current mirror output responsive to voltages on said current mirror outputs, wherein said selector is configured to select a said current mirror output having a voltage closest to a voltage of a power supply line of said current drive system, said power supply line configured to supply power to said plurality of current mirrors.

2. A current drive system as claimed in claim 1, wherein a said reference signal input comprises a voltage signal input, and wherein a said current mirror includes an input resistance to covert said voltage signal input to a reference current.

3. A current drive system as claimed in claim 1, wherein a said current mirror comprises a multiplying digital-to-analogue converter to provide an output current dependent upon a multiple of a said reference signal input.

4. A current drive system as claimed in claim 1, wherein said selector includes a control circuit to adjust said reference signal inputs to said current mirrors responsive to said selected current mirror output to maintain a mirror ratio of a reference signal input and said selected current mirror output, said mirror ratio being determined by said current mirror having said selected output.

5. A current drive system as claimed in claim 1, wherein said selector comprises a plurality of transistors, each having a control connection coupled to a said current mirror output, and input and output connections respectively connected in common, and wherein said common output connections provide an output voltage for providing said reference signal inputs to said currents mirrors.

6. A current drive system as claimed in claim 5, wherein said transistors comprise MOS transistors and wherein said input, output and control connections comprise, respectively, drain, source and gate connections.

7. A current drive system as claimed in claim 4, wherein said selector comprises a plurality of transistors, each having a control connection coupled to a said current mirror output, and input and output connections respectively connected in common, and wherein said common output connections provide an output voltage for providing said reference signal inputs to said currents mirrors, wherein said transistors comprise MOS transistors and wherein said input, output and control connections comprise, respectively, drain, source and gate connections, and wherein said control circuit comprises a non-inverting amplifier.

8. A current drive system as claimed in claim 5, wherein said transistors comprise MOS transistors and wherein said input, output and control connections comprise, respectively, source, drain and gate connections.

9. A current drive system as claimed in claim 4, wherein said selector comprises a plurality of transistors, each having a control connection coupled to a said current mirror output, and input and output connections respectively connected in common, and wherein said common output connections provide an output voltage for providing said reference signal inputs to said currents mirrors, wherein said transistors comprise MOS transistors and wherein said input, output and control connections comprise, respectively, source, drain and gate connections, and wherein said control circuit comprises an inverting amplifier.

10. A current drive system as claimed in claim 1, wherein said selector includes a plurality of operational amplifiers each having a first input coupled to a said current mirror output, a second input, and an output, and wherein said second inputs are connected in common to a reference and said outputs are coupled in common for providing said reference signal inputs to said current mirrors.

11. A current drive system as claimed in claim 1, wherein said electroluminescent display comprises an OLED display.

12. A current generator for an OLED display driver, said driver for multi-line addressing said display, the current generator comprising:

a reference input to receive a reference signal;

a ratioed current input to receive a ratioed current;

a ratio control input to receive a ratio control signal input;

a controllable current mirror having a control input coupled to said ratio control input, a current input coupled to said reference input, and an output coupled to said ratioed current input;

said current generator being configured such that a signal on said control input controls a ratio of said ratioed current to said reference signal; and wherein said current generator further comprises a plurality of drive connections each for driving a drive electrode of a display, and an automatic selector to select one of said drive connections to provide said reference signal, wherein said automatic selector is coupled to said drive connections to selectively couple a selected one of said drive connections to said reference input, the current generator comprising a plurality of said current mirrors, one for each of said plurality of drive connections, each with a ratio control input, and having a common reference input, wherein said selector is configured to select a said drive connection having a voltage which is closest to a supply voltage of said current generator, said supply voltage on a power supply line configured to supply power to said plurality of current mirrors.

13. A current driver circuit for driving a plurality of electrodes of an OLED display, said driving for multi-line addressing of said display, said driver circuit comprising:

at least one control input to receive a control signal;

a plurality of drive connections for driving said plurality of display electrodes;

an automatic selector configured to automatically select one of said plurality of drive connections as a first connection and at least one other of said drive connections as a second connection; and a driver configured to provide respective first and second drive signals for said first and second connections, a ratio of said first and second drive signals being controlled in accordance with said control signal, wherein said driver comprises at least two current mirrors each having a respective control input, a first of said current mirrors providing said first drive signal, a second of said current mirrors providing said second drive signal, and wherein said automatic selector is configured to automatically select one of said drive connections for providing a reference signal input to both said first and second current mirrors, wherein the automatic selector coal rises a selection circuit for controlling current drive in a multi-line addressing OLED display driver, the display having a the selection circuit comprising:

an output line to output an output reference signal for controlling of row connection drive signals on said row connections according to a common reference: and a plurality of input connections to receive signals from said rows of the OLED display;

a signal selector coupled to said plurality of input connections and to said output connection to automatically select a signal from a said input connection to provide said output reference signal, wherein said signal selector is configured to select a said input connection having a voltage closest to a voltage of a power supply line, said power supply line configured to supply power to a plurality of current mirrors for outputting said row connection drive signals.

14. A selection circuit for controlling current drive in a multi-line addressing OLED display driver, the display having a plurality of row connections for driving a plurality of rows of the display simultaneously, the circuit comprising;

an output line to output a reference signal for controlling of drive signals on said row connections according to a common reference a plurality of input connections to receive signals from said rows of the OLED display; and a selector coupled to said plurality of input connections and to said output connection to automatically select a signal from a said input connection to provide said reference signal, wherein said selector is configured to select a said input connection having a voltage closest to a voltage of a power supply line, said power supply line configured to supply power to a plurality of current mirrors, said plurality of current mirrors for outputting said drive signals.

15. A selection circuit as claimed in claim 14, wherein said reference signal is responsive to said selected input signal.

16. A selection circuit as claimed in claim 14, further comprising a control circuit to adjust said reference signal responsive to said selected input signal for said controlling according to the common reference.

17. A selector circuit as claimed in claim 14, said selection circuit comprising a plurality of transistors each having a control connection for coupling to a current mirror output, input connections connected together for connection to a supply, and output connections connected together to provide an output voltage corresponding to a voltage on a selected said input having a maximum or minimum voltage amongst the inputs.

18. A selector circuit as claimed in claim 14, said selection circuit comprising a plurality of operational amplifiers each having a first input, for coupling to a current mirror output, a second input and an output, and wherein said second inputs are connected in common for connection to a reference, and wherein said outputs are connected in common to provide an output for providing a reference for a said current mirror.

* * * * *

UNITED STATES PATENT AND TRADEMARK OFFICE

CERTIFICATE OF CORRECTION

PATENT NO. : 8,493,293 B2
APPLICATION NO. : 12/224815
DATED : July 23, 2013
INVENTOR(S) : Paul R. Routley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1254 days.

Signed and Sealed this
Seventh Day of July, 2015

Michelle K. Lee

Michelle K. Lee
*Director of the United States Patent and Trademark Office*